US007804014B2

(12) United States Patent
Terada

(10) Patent No.: US 7,804,014 B2
(45) Date of Patent: Sep. 28, 2010

(54) TONE PLATE FOR KEYBOARD-TYPE TONE PLATE PERCUSSION INSTRUMENT, TONE PLATE-FABRICATING METHOD, TONE GENERATOR UNIT OF TONE PLATE PERCUSSION INSTRUMENT, AND KEYBOARD-TYPE PERCUSSION INSTRUMENT

(75) Inventor: Norishige Terada, Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 12/429,559

(22) Filed: Apr. 24, 2009

(65) Prior Publication Data

US 2009/0211428 A1 Aug. 27, 2009

Related U.S. Application Data

(62) Division of application No. 11/610,018, filed on Dec. 13, 2006, now Pat. No. 7,541,530.

(30) Foreign Application Priority Data

Dec. 13, 2005 (JP) ..... 2005-359315
Dec. 13, 2005 (JP) ..... 2005-359317
Dec. 13, 2005 (JP) ..... 2005-359318

(51) Int. Cl.
*G10D 13/08* (2006.01)

(52) U.S. Cl. ..... 84/410; 84/402; 84/403; 84/404

(58) Field of Classification Search ..... 84/402–404, 84/410

See application file for complete search history.

(56) References Cited

U.S. PATENT DOCUMENTS 149,232 A * 3/1874 Lincoln ..... 84/404
1,173,507 A * 2/1916 Haskell ..... 84/170
1,192,324 A 7/1916 Kohler
1,283,774 A * 11/1918 Hope-Jones ..... 84/403

(Continued)

FOREIGN PATENT DOCUMENTS

AT 405 345 B 7/1999

(Continued)

OTHER PUBLICATIONS

"Celesta", Wikipedia, l'encyclopdie libre, Online, Sep. 21, 2004, p. 1, XP-002419666.

*Primary Examiner*—Jeffrey Donels
*Assistant Examiner*—Robert W Horn
(74) *Attorney, Agent, or Firm*—Dickstein Shapiro LLP

(57) ABSTRACT

A tone plate which makes it easy to reduce the entire length and width thereof, thus increasing the degree of freedom in design. The tone plate includes an antinode portion, front and rear ends, and first and second supporting holes which are located closer to the front and rear ends than to the antinode portion and at which a vibration node can be formed. There are provided first and second mass concentrating portions extending toward the front and rear ends from locations on a side close to the first and rear ends with respect to the supporting holes. First and second thinner portions are respectively provided between the antinode portion and the supporting holes. The tone plate vibrates to generate a musical tone of a specific tone pitch when struck with being supported at the supporting holes.

7 Claims, 14 Drawing Sheets

U.S. PATENT DOCUMENTS

| | | | | | |
|---|---|---|---|---|---|
| 1,323,132 | A | * | 11/1919 | Welch | 84/404 |
| 1,369,268 | A | * | 2/1921 | Deagan | 84/410 |
| 1,532,793 | A | | 4/1925 | Zepeda | |
| 1,575,960 | A | * | 3/1926 | Bartholomae | 84/403 |
| 1,632,751 | A | | 6/1927 | Winterhoff | |
| 1,664,587 | A | * | 4/1928 | Blalack | 84/404 |
| 1,807,057 | A | | 5/1931 | Bowers | |
| 1,838,502 | A | | 12/1931 | Schulter | |
| 2,020,150 | A | | 11/1935 | Ludwig et al. | |
| 2,287,138 | A | * | 6/1942 | Sas | 84/410 |
| 2,315,812 | A | | 4/1943 | O'Connell | |
| 2,317,164 | A | * | 4/1943 | Zimmerman | 84/403 |
| 2,347,287 | A | * | 4/1944 | Sas | 84/403 |
| 2,469,667 | A | * | 5/1949 | Burroughs | 84/404 |
| 2,901,936 | A | | 9/1959 | Scherer et al. | |
| 2,971,424 | A | | 2/1961 | Kent et al. | |
| 3,183,759 | A | * | 5/1965 | Bode | 84/402 |
| D212,172 | S | * | 9/1968 | Lewis | D17/22 |
| 3,443,469 | A | * | 5/1969 | Yoichi | 84/410 |
| 3,595,119 | A | | 7/1971 | Kuijpers et al. | |
| 3,633,453 | A | * | 1/1972 | Musser | 84/403 |
| 3,705,527 | A | * | 12/1972 | Burnham | 84/403 |
| 3,858,477 | A | * | 1/1975 | Kawakami | 84/410 |
| 3,981,221 | A | * | 9/1976 | Wittel | 84/423 R |
| 4,058,044 | A | | 11/1977 | Murakami | |
| 4,111,094 | A | * | 9/1978 | Broser | 84/402 |
| 5,198,602 | A | | 3/1993 | Roper | |
| 5,207,769 | A | * | 5/1993 | Malta | 84/404 |
| 5,235,892 | A | * | 8/1993 | Terada et al. | 84/404 |
| 5,313,867 | A | * | 5/1994 | Terada et al. | 84/404 |
| D348,281 | S | | 6/1994 | Ito | |
| 5,458,037 | A | | 10/1995 | Harman | |
| 5,686,679 | A | * | 11/1997 | Nakano et al. | 84/402 |
| 5,902,945 | A | * | 5/1999 | Nakano et al. | 84/402 |
| 6,838,604 | B2 | | 1/2005 | Abe et al. | |
| 7,161,078 | B2 | * | 1/2007 | Becker-Ehmck | 84/410 |
| 7,528,310 | B2 | * | 5/2009 | Terada et al. | 84/402 |
| 7,528,311 | B2 | * | 5/2009 | Terada et al. | 84/410 |
| 7,541,530 | B2 | * | 6/2009 | Terada | 84/403 |
| 7,560,629 | B2 | * | 7/2009 | Terada et al. | 84/236 |
| 7,633,001 | B2 | * | 12/2009 | Terada | 84/423 R |
| 7,642,437 | B2 | * | 1/2010 | Terada | 84/179 |
| 2007/0131092 | A1 | | 6/2007 | Terada | |
| 2007/0137458 | A1 | | 6/2007 | Terada | |
| 2008/0168885 | A1 | | 7/2008 | Terada et al. | |
| 2008/0245209 | A1 | | 10/2008 | Terada et al. | |
| 2009/0211428 | A1 | * | 8/2009 | Terada | 84/403 |

FOREIGN PATENT DOCUMENTS

| | | | |
|---|---|---|---|
| DE | 445861 | | 6/1927 |
| DE | 91 10 619.2 | U1 | 10/1991 |
| DE | 103 57 326 | A1 | 6/2005 |
| EP | 0 489 430 | A2 | 6/1992 |
| EP | 0 723 255 | A2 | 7/1996 |
| EP | 0 831 454 | A2 | 3/1998 |
| GB | 144 247 | | 9/1920 |
| JP | S47-37721 | | 12/1972 |
| JP | 04-372993 | A | 12/1992 |
| JP | 5-81895 | | 11/1993 |
| JP | 8-202351 | A | 8/1996 |
| JP | 8-254976 | A | 10/1996 |
| JP | 10-097241 | A | 4/1998 |
| NL | 7605085 | | 11/1977 |

* cited by examiner

TONE PLATE FOR KEYBOARD-TYPE TONE PLATE PERCUSSION INSTRUMENT, TONE PLATE-FABRICATING METHOD, TONE GENERATOR UNIT OF TONE PLATE PERCUSSION INSTRUMENT, AND KEYBOARD-TYPE PERCUSSION INSTRUMENT

CROSS-REFERENCE TO RELATED APPLICATIONS

This application is a divisional of U.S. patent application Ser. No. 11/610,018, filed Dec. 13, 2006, the entirety of which is incorporated herein by reference.

BACKGROUND OF THE INVENTION

1. Field of the Invention

The present invention relates to a tone plate for use in a keyboard-type tone plate percussion instrument, which is adapted to vibrate to thereby generate a musical tone of a specific tone pitch when struck, a method for fabricating the tone plate, a tone generator unit of a tone plate percussion instrument including tone plates and a resonance box for causing musical tones generated by the tone plates to resonate therein, and a keyboard-type percussion instrument.

This application claims priority to Japanese Patent Application Nos. 2005-359315, 2005-359317, and 2005-359318, the contents of which are incorporated herein by reference.

2. Description of the Related Art

As disclosed in Japanese Utility Model Laid-open Publication (Kokai) No. H05-081895, a conventional keyboard-type tone plate percussion instrument includes, as sounding members, a plurality of tone plates each adapted to generate, when struck, a musical tone of a specific tone pitch (hereinafter referred to as the first prior art). The tone plates are generally formed into a flat plate, and in most keyboard-type tone plate percussion instruments, they are differed from one another mainly in length so as to generate different specific tone pitches.

In the tone plate percussion instrument of this type, it has also been known to provide a resonance box for causing musical tones generated by a plurality of tone plates to resonate therein. For example, the keyboard-type tone plate percussion instrument according to the first prior art is provided with a resonance box having resonance chambers in each of which a corresponding one of musical tones generated by the tone plates is caused to resonate.

In this keyboard-type tone plate percussion instrument, the tone plates constituting a tone plate group are fixed for vibration by means of a pin or the like to a supporting part, which is turn fixed to the musical instrument main body. The resonance box is arranged close to the tone plate group and fixed to the instrument main body by wood screws extending through elongated holes that are formed in resonance-box fixing rails attached to the instrument main body.

Further, as disclosed in the keyboard-type tone plate percussion instrument according to the first prior art, it has been known to provide percussion units such as hammer action units in the percussion instrument in addition to sounding members such as tone plates, whereby in response to a key depression operation, a corresponding percussion unit hits a corresponding one of the sounding members to thereby generate a musical tone of a specific tone pitch.

In this keyboard-type tone plate percussion instrument, the sounding members are fixed for vibration to a supporting part of the instrument by means of a pin or the like, and resonance boxes are provided that have an opening side arranged close to the sounding members. The percussion units are each disposed below a corresponding one of the sounding members. The just-mentioned mechanism is constructed into an upper and lower two-stage structure.

In the keyboard-type tone plate percussion instrument based on the first prior art, however, the tone plate group and the resonance box are fixed to the musical instrument main body independently of each other, making it difficult to carry out the mounting operation thereof to the musical instrument. In addition, the tone plates must be mounted one by one, thus further complicating the tone plate mounting operation.

In order to change the tone color of this tone plate percussion instrument, the tone plate group and/or the resonance box must be individually replaced by different ones. Upon such replacement, a fine adjustment is required of the distance and positional relation between the tone plate group and the resonance box in order to maintain the desired sounding capability of the tone plate percussion instrument, which further increases the difficulty of replacement. This also applies to the maintenance of the tone plate group and/or the resonance box.

Moreover, in the keyboard-type tone plate percussion instrument according to the first prior art, there is a fixed, one-on-one based relationship between the keys, percussion units, and sounding members. Therefore, when any one of the keys is depressed, a percussion unit fixedly corresponding thereto is driven to strike a sounding member, which in turn fixedly corresponds to the driven percussion unit. Thus, that sounding member which is struck by a given percussion unit is always the same. It is therefore impossible to carry out key transposition, for example. From the viewpoint of providing a variety of musical performances, there is a room for improving the keyboard-type tone plate percussion instrument.

Still another type of tone plate has also been known as disclosed in Japanese Patent Laid-open Publication (Kokai) No. H08-202351, in which the tone plate has its thickness varying in the longitudinal direction thereof. The tone plate is made thinner at a longitudinally center portion thereof by cutting or the like so as to attain a frequency ratio of 1:4:8 between primary, secondary, and tertiary modes in which the tone plate vibrates, thereby improving harmony, volume, and interval of chord tone generated by the tone plate percussion instrument (hereinafter referred to as the second prior art)

However, in the keyboard-type tone plate percussion instrument according to the second prior art, tone plates for generating lower pitch tones are made longer in entire length. In particular, tone plates for a low tone pitch range are wide in width and extremely long in entire length. The necessity for satisfying the above requirement for the tone plate size poses a problem that the degree of freedom in design decreases. For example, this results in increase in the entire instrument size, especially in a case where the keyboard-type tone plate percussion instrument includes a large number of tone plates so as to cover a wide range of pitch.

SUMMARY OF THE INVENTION

A first object of the present invention is to provide a tone plate for use in a keyboard-type tone plate percussion instrument, which makes it easy to reduce the entire length and width of the tone plate to thereby increase the degree of freedom in design, as well as to provide a method of fabricating the tone plate, and a keyboard-type percussion instrument.

A second object of the present invention is to provide a tone generator unit of a tone plate percussion instrument, which makes it easy to replace the entire tone plate unit while maintaining a proper positional relationship between a resonance box and tone plates to thereby easily carry out tone color change in an acoustic musical instrument as well as to provide a keyboard-type percussion instrument.

To attain the first object, according to a first aspect of the present invention, there is provided a tone plate for use in a keyboard-type tone plate percussion instrument, comprising a longitudinal central portion, first and second ends, first and second supported portions respectively located at first longitudinal locations in the tone plate which are closer to the first and second ends than to the longitudinal central portion and at each of which a vibration node can be formed, first and second mass concentrating portions extending toward the first and second ends from second longitudinal locations in the tone plate that are on a side close to the first and second ends with respect to the first and second supported portions, respectively, and first and second thinner portions respectively provided between the longitudinally central portion and the first supported portion and between the longitudinally central portion and the second supported portion, wherein the tone plate is made of a single material and formed into one piece, the tone plate vibrating to generate a musical tone of a specific tone pitch when it is struck with being supported at the first and second supported portions thereof.

With this construction, it is easy to reduce the entire length and width of the tone plate, thereby making it possible to increase the degree of freedom in designing the tone plate.

Preferably, the first and second mass concentrating portions are each thicker than the longitudinally central portion in a thickness direction of the tone plate, and the first and second thinner portions are each thinner than the longitudinally central portion in the thickness direction of the tone plate.

With this construction, it is easy to equalize the widths of a plurality of tone plates having different tone pitches.

Preferably, the first and second mass concentrating portions and the longitudinally central portion extend beyond the first and second thinner portions toward one side of the tone plate in the thickness direction of the tone plate.

With this construction, the tone plate can be formed by cutting only those parts of a plate material which are on one side of the plate material as viewed in the thickness direction thereof, making it easy to carry out machining for fabrication of the tone plate from the plate material.

Preferably, the first and second supported portions are comprised of engagement portions that are formed substantially along a width direction of the tone plate.

With this construction, a plurality of tone plates can collectively be held by means of a cord member that is adapted to be engaged with the engagement portions formed in the tone plates, for instance.

To attain the second object, according to a second aspect of the present invention, there is provided a method for fabricating a tone plate for use in a keyboard-type tone plate percussion instrument from an elongated member made of a single material and having a rectangular cross section, the tone plate comprising a longitudinal central portion, first and second ends, and first and second supported portions respectively located at first longitudinal locations in the tone plate which are closer to the first and second ends than to the longitudinal central portion and at each of which a vibration node can be formed, the method comprising the steps of (a) removing, by cutting and/or grinding, a first part of the elongated member extending between first and second equivalent longitudinal locations therein, which respectively correspond to second longitudinal locations in the tone plate that are on a side close to the first and second ends with respect to the first and second supported portions, to thereby form first and second mass concentrating portions of the tone plate respectively extending toward the first and second ends from the second longitudinal locations, and (b) forming first and second thinner portions of the tone plate at second and third parts of the elongated member, which respectively correspond to between the longitudinally central portion and the first supported portion and between the longitudinally central portion and the second supported portion of the tone plate, wherein the tone plate vibrates to generate a musical tone of a specific tone pitch when it is struck with being supported at the first and second supported portions thereof.

According to this construction, it is easy to reduce the entire length and width of the tone plate, thereby making it possible to increase the degree of freedom in designing the tone plate. In addition, the tone plate can easily be fabricated.

Preferably, in the step (b), part of the elongated member to be removed is removed from one direction, to thereby form the first and second thinner portions so as to be thinner than the longitudinally central portion in a thickness direction of the elongated member, while permitting each of the first and second mass concentrating portions to be thicker than the longitudinally central portion in the thickness direction of the elongated member.

With this construction, the tone plate can be fabricated by removing the part to be removed of the elongated member from one direction, which increases the ease of fabrication of the tone plate and which makes it easy to equalize widths of tone plates having different tone pitches.

To attain the second object, according to a third aspect of the present invention, there is provided a tone generator unit of a tone plate percussion instrument, comprising a plurality of tone plates each adapted to vibrate to generate a musical tone of a specific tone pitch when struck, and a resonance box having a plurality of resonance chambers corresponding to respective ones of the plurality of tone plates and each having an opening side thereof, wherein the plurality of tone plates are mounted to the resonance box so as to be capable of vibrating, with each of the tone plate located close to the opening side of a corresponding one of the resonance chambers, whereby the resonance box and the plurality of tone plates are formed into one unit.

With this construction, the entire tone generator unit can easily be replaced while maintaining a proper positional relationship between the resonance box and the tone plates, which makes it easy to change the tone color in the acoustic musical instrument.

Preferably, the tone generator unit further includes a holder member for collectively holding at least two of the plurality of tone plates so as to be capable of vibrating, and attachment members for attaching the holder member to the resonance box.

With this construction, the tone plate group can collectively be mounted to and detached from the resonance box, thereby increasing the ease of mounting of the tone plates and replacement thereof.

Preferably, the holder member is comprised of a cord member, each of the at least two of the plurality of tone plates is formed with through holes that extend in a direction of array of the plurality of tone plates, and the holder member passes through the through holes formed in the at least two of the plurality of tone plates whereby the at least two of the plurality of tone plates are held by the holder member so as to be suspended therefrom.

With this construction, the tone plate group can collectively be handled using the cord member, which further increases the ease of mounting the tone plates and replacement thereof.

Preferably, a distance between adjacent ones of the plurality of tone plates is temporarily determined by an associated at least one of the attachment members when the plurality of tone plates are mounted to the resonance box.

With this construction, when the tone plates are mounted to the resonance box, they can easily be positioned in the direction in which the keys are arranged.

Preferably, the resonance box includes first and second common walls extending substantially along a direction in which the plurality of tone plates are arranged, and a plurality of chamber-defining members that are formed between the first and second common walls and define the plurality of resonance chambers, among the plurality of resonance chambers, a plurality of predetermined resonance chambers corresponding to at least part of a range of the percussion instrument are defined to correspond, on a one-on-one basis, to associated ones of the plurality of tone plates, each of the plurality of predetermined resonance chambers overlaps at least one of other predetermined resonance chambers as seen from front thereof, and a maximum width of each of the plurality of predetermined resonance chambers as viewed in the direction in which the plurality of tone plates are arranged is as large as at least twice a width of the corresponding tone plate.

With this construction, the tone plate group and the resonance box of the entire musical instrument can be constructed into a single-stage structure while ensuring proper widths of resonance chambers.

To attain the first object, according to a fourth aspect of the present invention, there is provided a keyboard-type percussion instrument, comprising a plurality of keys that constitute a keyboard, and a plurality of sounding members arranged in a direction in which the plurality of keys are arranged, each of the plurality of sounding members being made of a single material and formed into one piece, wherein each of the plurality of sounding members comprises a longitudinal central portion, first and second ends, first and second supported portions respectively located at first longitudinal locations which are closer to the first and second ends than to the longitudinal central portion and at each of which a vibration node can be formed, first and second mass concentrating portions extending toward the first and second ends from second longitudinal locations in the sounding member that are on a side close to the first and second ends with respect to the first and second supported portions, respectively, and first and second thinner portions respectively provided between the longitudinally central portion and the first supported portion and between the longitudinally central portion and the second supported portion, and wherein the each sounding member vibrates to generate a musical tone of a specific tone pitch when it is struck with being supported at the first and second supported portions thereof.

With this construction, it is easy to reduce the entire length and width of the sounding member in the keyboard-type percussion instrument, making it possible to increase the degree of freedom in designing the sounding member.

Preferably, the keyboard-type percussion instrument further includes a plurality of percussion units arranged to respectively correspond to the plurality of keys and the plurality of sounding members, each percussion unit striking a corresponding one of the plurality of sounding members when driven by a depressing operation of a corresponding one of the plurality of keys, wherein a relative position between each of the plurality of keys and a corresponding one of the plurality of sounding members in the direction in which the plurality of keys are arranged can be varied, and when the relative position is varied, a correspondence relationship between corresponding ones of the plurality of sounding members and the percussion units changes, and that sounding member which can be struck by the percussion unit driven by the key depressing operation is thereby made different from that one which can be struck by the driven percussion unit before the relative position is varied.

With this construction, key transposition can be implemented in the acoustic sounding keyboard-type percussion instrument, making it possible to provide a variety of musical performances.

Preferably, the plurality of percussion units are configured to move in unison with the plurality of keys in the direction in which the plurality of keys are arranged.

With this construction, a mechanism for shift alteration in a grand piano can be applied, for instance, making it possible to implement the key transposition with a simple construction.

Preferably, the keyboard-type percussion instrument further includes a resonance box disposed fixedly with respect to and closely to the plurality of sounding members, wherein the plurality of sounding members and the resonance box are configured to move in unison in the direction in which the plurality of keys are arranged.

With this construction, the key transposition can be implemented, while maintaining satisfactory sounding capability of sounding members.

To attain the second object, according to a fifth aspect of the present invention, there is provided a keyboard-type percussion instrument, comprising a plurality of keys that constitute a keyboard, and a tone generator unit including a plurality of sounding members and a resonance box having a plurality of resonance chambers corresponding to respective ones of the plurality of sounding members, wherein the plurality of sounding members of the tone generator unit are arranged in a direction in which the plurality of keys are arranged, and each of the plurality of sounding members vibrates to generate a musical tone of a specific tone pitch when it is struck, the plurality of resonance chambers of the tone generator unit each have an opening side thereof, and the plurality of tone plates are mounted to the resonance box so as to be capable of vibrating, with each of the tone plates located close to the opening side of a corresponding one of the resonance chambers, whereby the resonance box and the plurality of tone plates are formed into one unit.

With this construction, it is possible to increase the ease of replacement of the entire tone generator unit while maintaining a proper positional relationship between the resonance box and the sounding members, making it possible to easily change the tone color of an acoustic keyboard-type percussion instrument.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail below with reference to the drawings showing preferred embodiments thereof.

Figure 1:
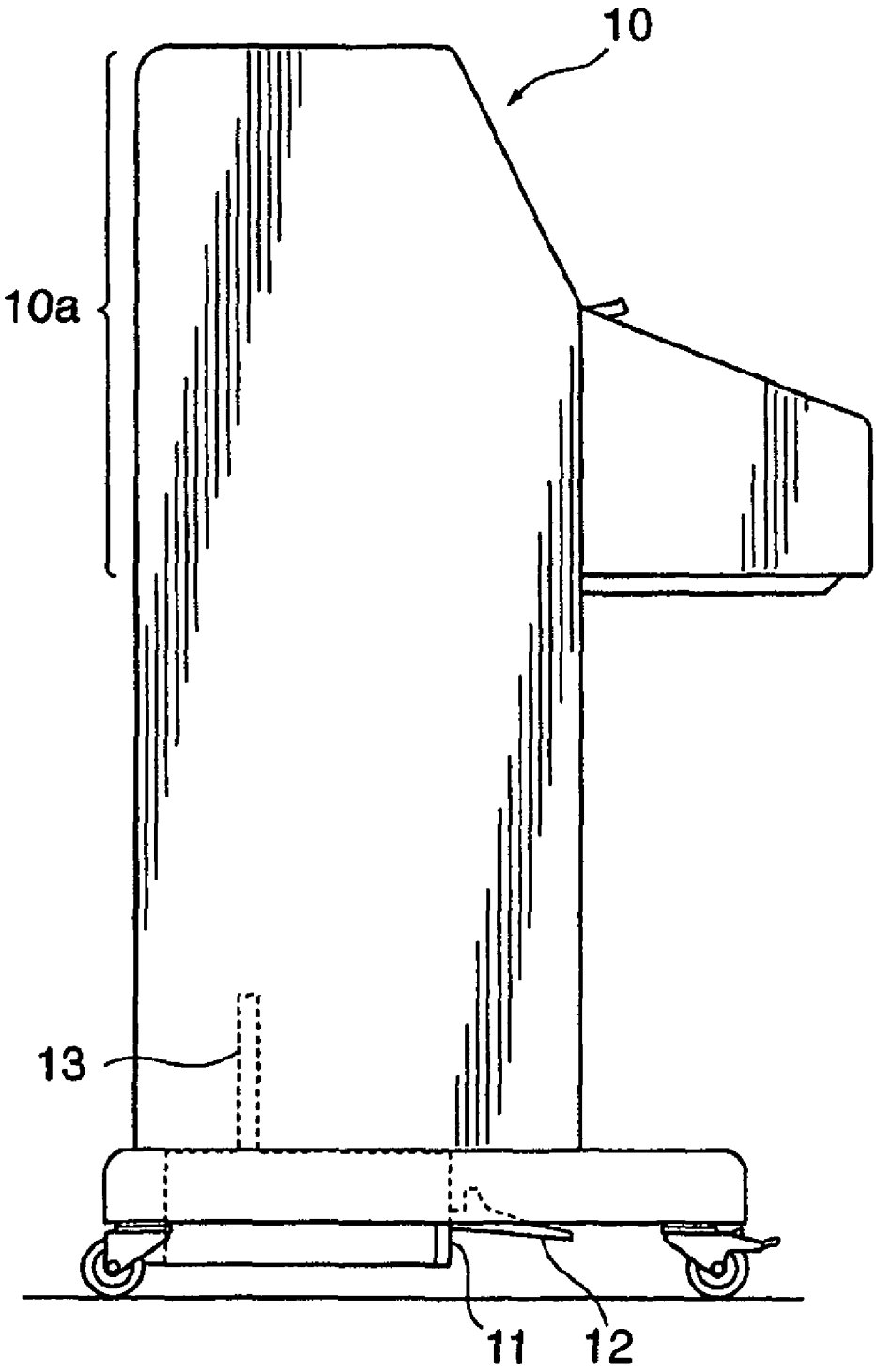
FIG. 1 is a left side view of a keyboard instrument constructed as a keyboard-type tone plate percussion instrument to which is applied a tone generator unit that includes a plurality of tone plates, which are sounding members according to a first embodiment of the present invention.

FIG. 1 is a left side view of a keyboard instrument that is constructed as a keyboard-type tone plate percussion instrument to which is applied a tone generator unit that includes a plurality of tone plates, which are sounding members according to a first embodiment of the present invention. Roughly speaking, the keyboard instrument 10 is analogous in appearance to an upright piano, but does not include any strings. Instead, the keyboard instrument 10 includes tone plates that are similar to those of a celesta and provided in an upper half 10*a* of the keyboard instrument 10. When struck, each of the tone plates vibrates and generates a musical tone. The keyboard instrument 10 includes a resonance box that causes the musical tone generated by the corresponding tone plate to resonate therein. As mechanisms for striking the tone plates, there are provided mechanisms similar to action mechanisms for a grand piano but not for an upright piano.

In the following, the side of the keyboard instrument 10 toward a player will be referred to as the front side, and the left and right directions are determined in reference to the player. A pedal box 11 is provided in a lower part of the keyboard instrument 10, and a damper pedal 12 is extended forwardly from the pedal box 11.

The keyboard instrument 10 is analogous to a celesta in which tone plates formed into a flat plate are used as sounding members. A plurality of tone plates (mentioned later with reference to FIG. 5), which are sounding members in the present embodiment, are thick and formed into a rod rather than a plate. Thus, the term "tone plate" might not be appropriate. Nevertheless, since the term "tone plate" has commonly been used in the field of celesta, the sounding members used in the keyboard instrument 10 are referred to as the "tone plates 30." As will be described in detail later, the resonance chambers of the present embodiment are creative in shape to realize a single-stage structure of a tone plate group and a resonance box, while ensuring appropriate widths of the resonance chambers.

Figure 2:
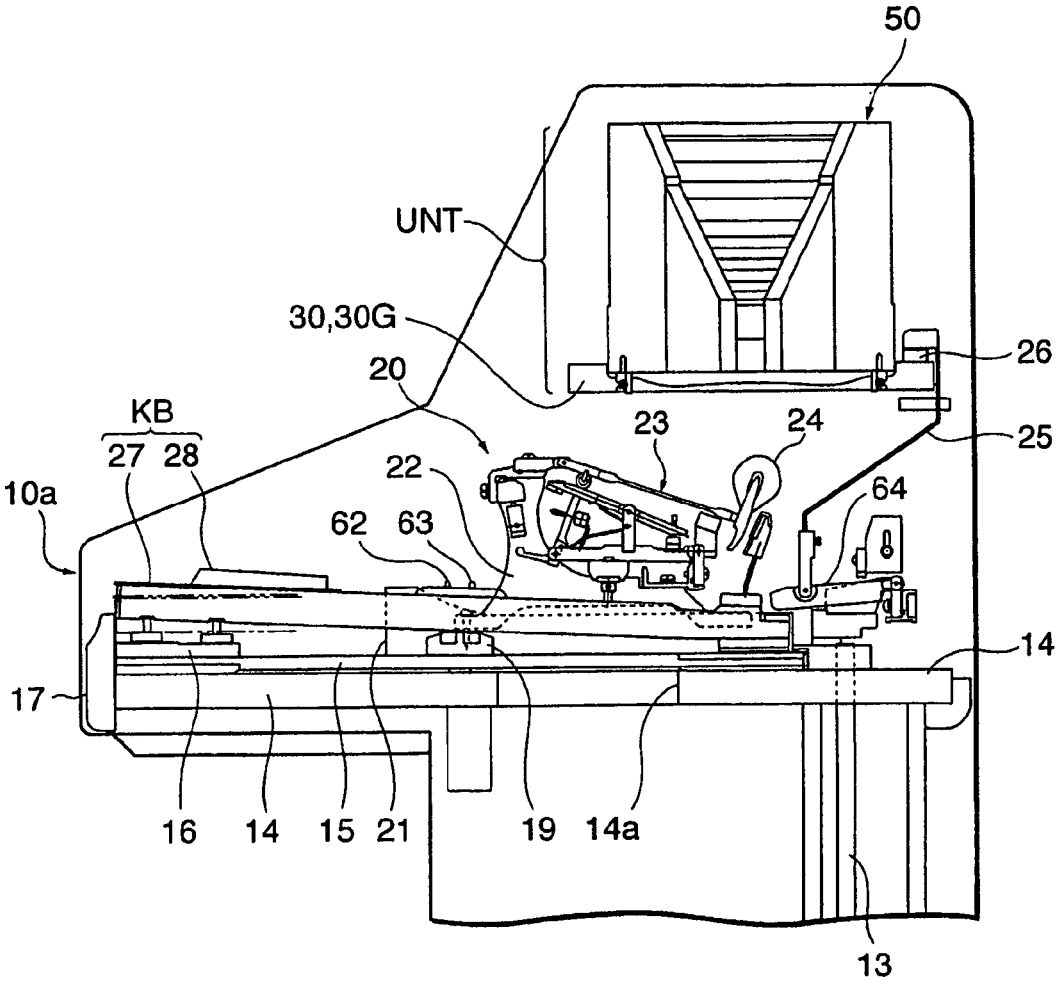
FIG. 2 is a right sectional view showing the internal construction of an upper half of the keyboard instrument.
Figure 3:
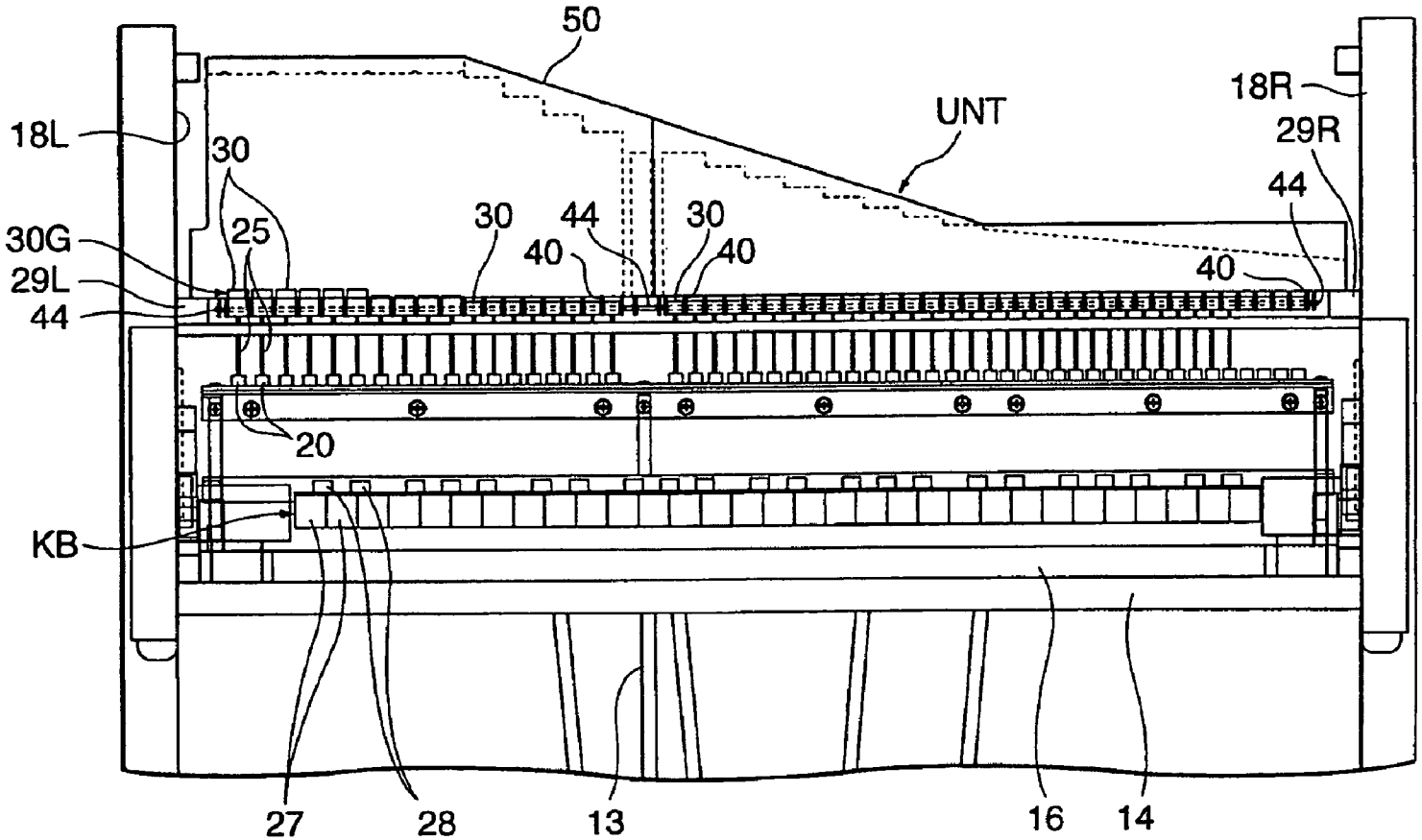
FIG. 3 is a front view showing the internal construction of the upper half of the keyboard instrument.
Figure 4:
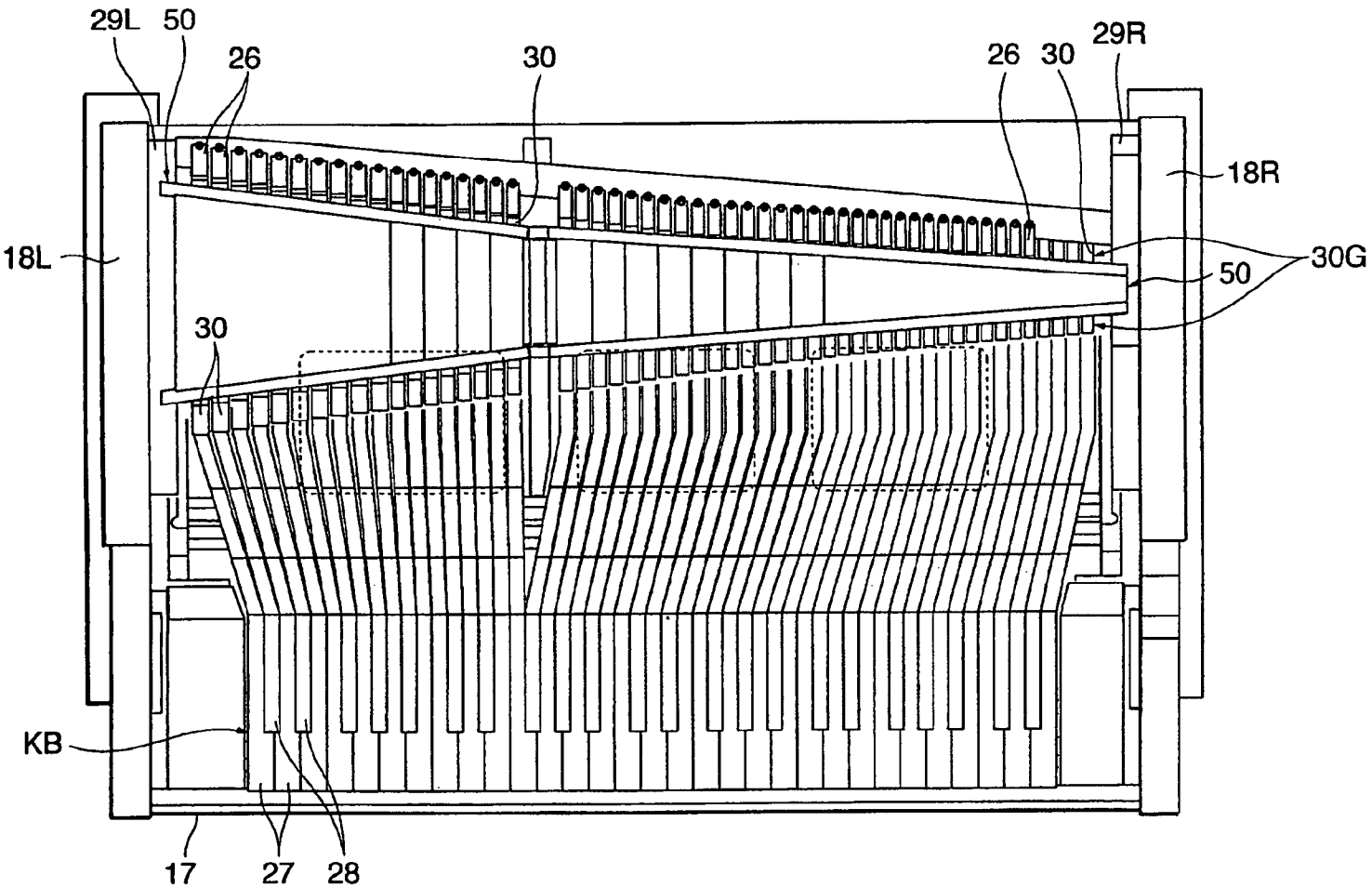
FIG. 4 is a plan view showing the internal construction of the upper half of the keyboard instrument.

FIG. 2 is a right side view showing the internal construction of the upper half 10*a* of the keyboard instrument 10, FIG. 3 is a front view showing the internal construction of the upper half 10*a*, and FIG. 4 is a plan view showing the internal construction of the upper half 10*a*.

As shown in FIG. 2, a key frame 15 is disposed on a key bed 14 which is provided in a lower part of the upper half 10*a* of the keyboard instrument 10, and a front rail 16 is formed on the front side of the key frame 15. The key frame 15 is provided with a balance rail 19 that supports a plurality of white keys 27 and a plurality of black keys 28 of a keyboard KB for vertical pivotal motion (seesaw motion) around respective ones of balance pins 62, 63 that are provided in the balance rail 19. A front portion of the front rail 16 is covered by a keyslip 17 over the entire width of the keys (also refer to FIG. 4). In FIG. 3, the illustration of the keyslip 17 is omitted.

Action mechanisms 20 are disposed through action brackets on an upper portion of a rear half of the key frame 15. The action brackets 22 and the action mechanisms 20 are arranged to correspond to respective ones of the keys 27, 28. The action mechanisms 20 are the same in construction as those of a grand piano. Atone generator unit UNT, including a wood resonance box 50 and a tone plate group 30G comprised of a plurality of tone plates 30, is disposed above the action mechanisms 20. The tone plates 30 are provided to correspond to respective ones of the keys 27, 28. When any one of the keys 27, 28 is depressed, a corresponding hammer 23 is pivoted upward and then a hammer felt 24 strikes a corresponding tone plate 30, which vibrates and generates a musical tone that resonates in the resonance box 50. The key bed 14 disposed below the action mechanisms 20 is formed with sound output ports 14*a*.

A plurality of pivotal members 64 are provided above rear ends of the keys 27, 28 so as to correspond to respective ones of the keys 27, 28, and damper felts 26 are provided on respective ones of damper wires 25 extending from the pivotal members 64 (refer to FIG. 3). When the damper pedal 12 is not stepped on, each of the damper felts 26 is in contact with the upper face of a rear end of the corresponding tone plate 30. When any one of the keys is depressed, the corresponding damper felt 26 is caused, via the damper wire 25, to be separated from the corresponding tone plate 30. A pedal coupling rod 13 is coupled to the damper pedal 12. When the damper pedal 12 is stepped on, all the damper felts 26 are lift up by means of the pedal coupling rod 13 and all the damper wires 25.

As shown in FIGS. 3 and 4, supporting portions 29L, 29R are fixed to inner sides of side plates 18L, 18R that constitute right and left sides of the keyboard instrument 10. As will be described later, the tone generator unit UNT is comprised of the resonance box 50 and the tone plate group 30G mounted for vibration thereto, which are formed into one piece. When mounted to and dismounted from the keyboard instrument 10, the tone generator unit is handled as an integrated piece. The resonance box 50 has its left and right sides fixed to the support portions 29L, 29R by means of screws, not shown, whereby the tone generator unit UNT is received in the upper half 10*a* of the keyboard instrument 10.

Figure 5A:
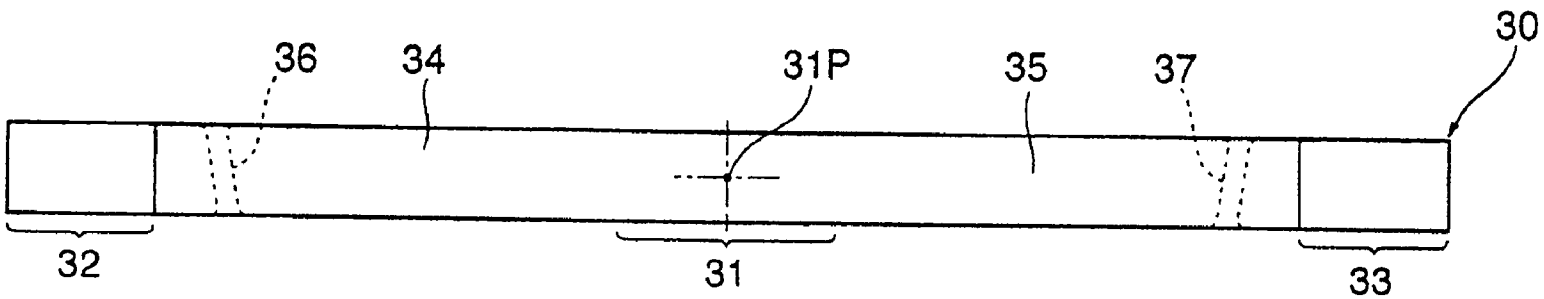
FIG. 5A is a plan view of a tone plate.
Figure 5B:
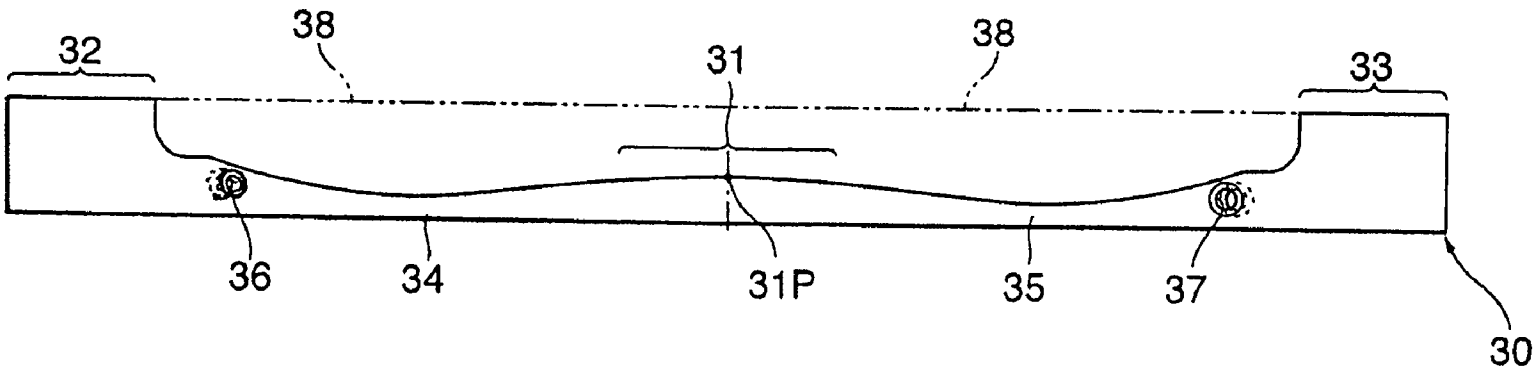
FIG. 5B is a right side view of the tone plate.
Figure 6:
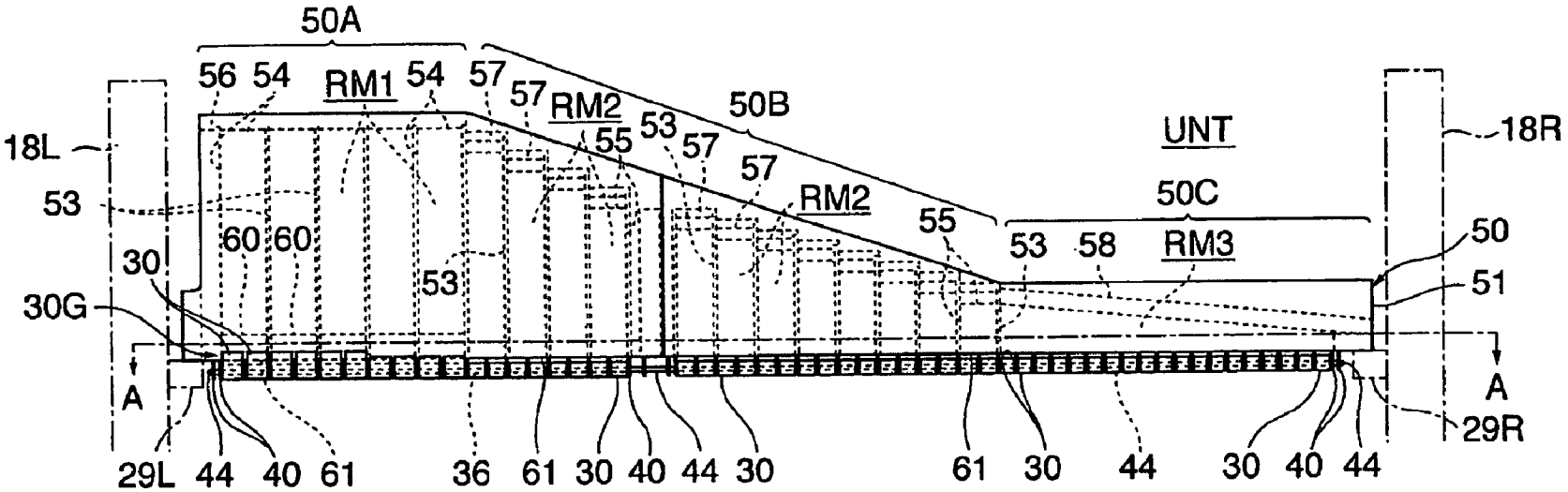
FIG. 6 is a front view of a tone generator unit.
Figure 7:
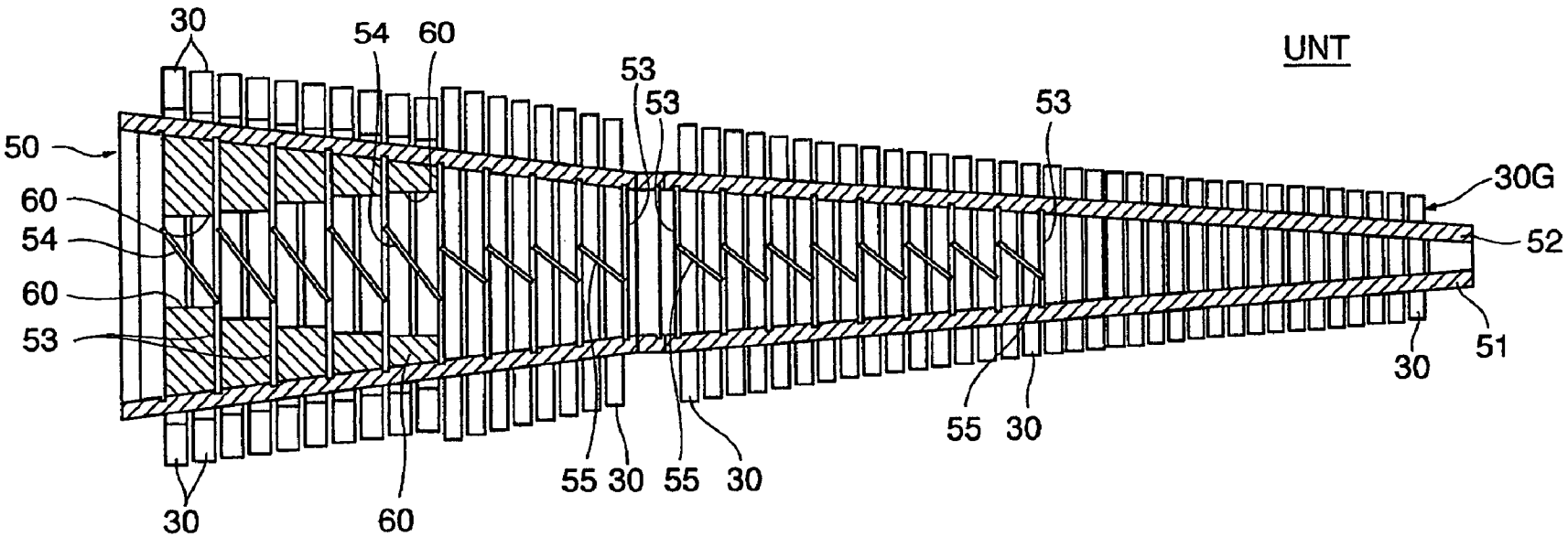
FIG. 7 is a section view taken along line A-A shown in FIG. 6.
Figure 8:
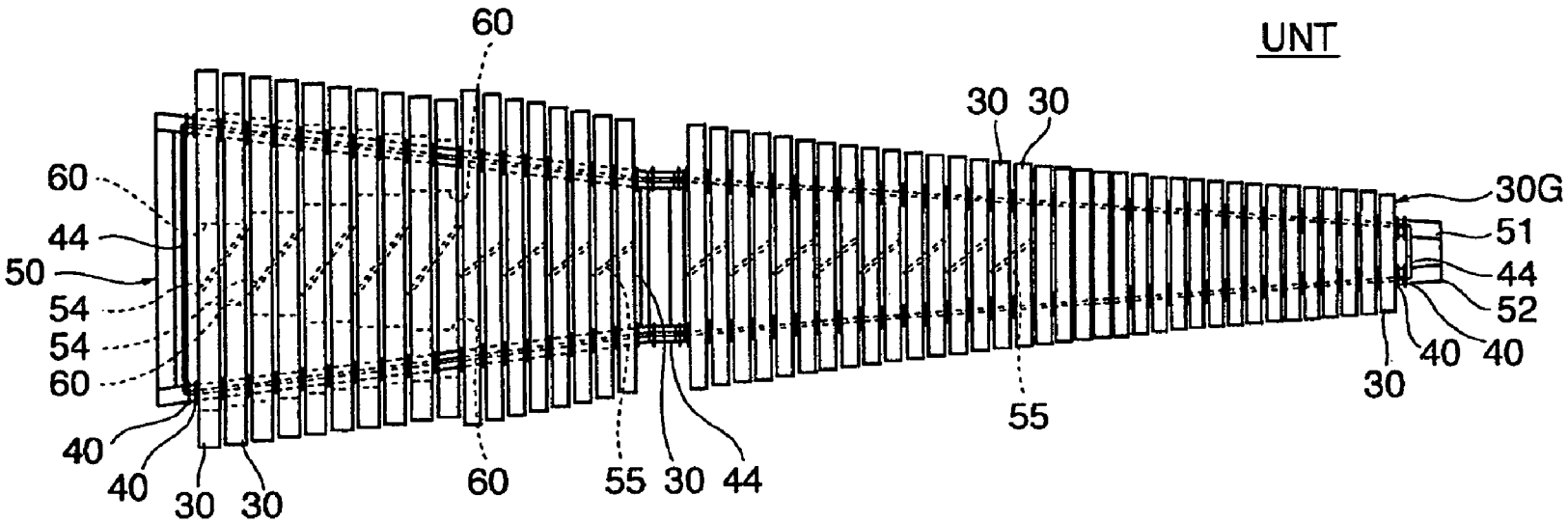
FIG. 8 is a bottom view of the tone generator unit.

Next, an explanation will be given of the construction of the tone generator unit UNT. FIG. 5A is a plan view of one tone plate 30, and FIG. 5B is a right side view of the tone plate 30. FIG. 6 is a front view of the tone generator unit UNT, FIG. 7 is a section view taken along line A-A in FIG. 6, and FIG. 8 is a bottom view of the tone generator unit UNT.

First, the tone plate group 30G will be explained. The tone plate group 30G is comprised of tone plates 30 that are equal in number to the keys. Each of the tone plates 30 vibrates when struck by the corresponding hammer felt 24 and generates a musical tone of a specific tone pitch. The tone plates 30 are different in shape such as the entire length or the like from one another (refer to FIGS. 7, 8 and 9C-9E), thereby generating musical tones having different specific pitches. The tone plates 30 constituting the tone plate group 30G are constructed into a single-stage structure, in which they are arranged in the order of tone pitch in the direction in which the keys are arranged and those tone plates 30 neighboring in specific pitch are arranged adjacent to each other (refer to FIGS. 3 and 6-8). It should be noted that the above-described action mechanisms 20 are also constructed into a single-stage structure where they are arranged to correspond to the array of the tone plates 30 in the direction in which the keys are arranged. In FIGS. 5A and 5B, there are shown tone plates 30 belonging to a low-pitch range portion 50A (mentioned later) of the resonance box 50.

As shown in FIGS. 5A and 5B, each of the tone plates 30 is formed with supporting holes 36 and 37, serving as first and second supported portions, at those positions of the tone plate which are closer to the front and rear ends (first and second ends) than to a longitudinally central portion and at which vibration nodes can be formed. The supporting holes 36, 37 are through holes through which a coupling cord 44 (refer to FIGS. 3, 6 and 8) extends. Among the tone plates 30, tone plates for a low tone pith range are disposed on the left side and made longer in entire length, and therefore the distances between their supporting holes 36, 37 are long in length. The supporting holes 36, 37 of each tone plate 30 extend in the width direction of the tone plate. Specifically, however, the supporting holes 36, 37 of each tone plate extend obliquely as seen from above such that they are closer to the front/rear side of the keyboard instrument 10 on the left side of the tone plate than on the right side, so as to be aligned with the supporting holes 36, 37 of the adjacent tone plates 30 (refer to FIG. 5A).

The supporting holes 36, 37 of each tone plate 30 are provided in positions at which vibration nodes can be formed, and therefore, the tone plate 30 effectively generates a musical tone when caused to vibrate in a state where the tone plate 30 is supported at the supporting holes 36, 37. A longitudinally central portion of the tone plate 30 is a portion where a vibration antinode can be formed (hereinafter referred to as the "antinode portion 31"). The center of the antinode portion 31 is located at a position corresponding to the antinode center of vibration (hereinafter referred to as the "antinode center 31P"). The tone plate 30 has its lower surface that is flat. The front and rear portions of the tone plate 30 project upward and are formed to be thick, whereby these portions constitute first and second mass concentrating portions 32, 33 on which the mass of the tone plate concentrates. The provision of the first and second mass concentrating portions 32, 33 makes it possible to shorten the entire length of the tone plate, in particular, the entire length of the tone plate belonging to the low tone pitch range.

As viewed in the vertical direction (thickness direction), the antinode portion 31 of the tone plate 30 is concave upward and made thinner than the first and second mass concentrating portions 32, 33. First and second thinner portions 34, 35 which are thinner in thickness than the antinode portion 31 are provided between the antinode portion 31 and the first mass concentrating portion 32 and between the antinode portion 31 and the second mass concentrating portion 33.

The resonance box 50 of the tone generator unit UNT is comprised of the low-pitch range portion 50A, a mid-pitch range portion 50B, and a high-pitch range portion 50C that are arranged in the mentioned order as seen from the low-pitch side (refer to FIG. 6). The tone plates 30 are not equal from one another in width measured in the right-to-left direction although those tone plates 30 belonging to the same pitch range portion have the same width. Specifically, the tone plates 30 corresponding to the low-pitch range portion 50A of the resonance box 50 are largest in width, whereas the tone plates 30 corresponding to the high-pitch range portion 50C is smallest in width.

The tone plates 30 are each made of a single material such as aluminum, aluminum allow, or steel, and formed into one piece. In fabricating the tone plate, an elongated member of a single material which is rectangular in cross section (an unmachined member 38 shown in FIG. 5B) may be machined from one direction (from above in the example shown in FIG. 5). Specifically, in machining, that portion of the unmachined member which extends from a position on the side close to the front end with respect to the supporting hole 36 to a position on the side close to the rear end with respect to the supporting hole 37 is removed from one direction by cutting and/or grinding the same, thereby forming the antinode portion 31, first and second mass concentrating portions 32, 33, and first and second thinner portions 34, 35.

Figure 9A:
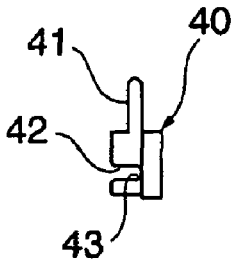
FIG. 9A is a side view showing a fastener for collectively holding a tone plate group.
Figure 9B:
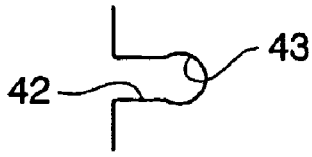
FIG. 9B is a fragmentary enlarged view of the fastener.
Figure 9C:
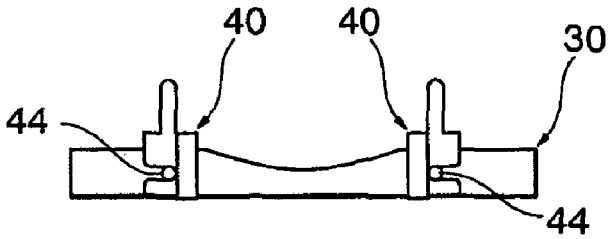
FIG. 9C is a side view showing tone plates corresponding to a high-pitch range, together with fasteners.
Figure 9D:
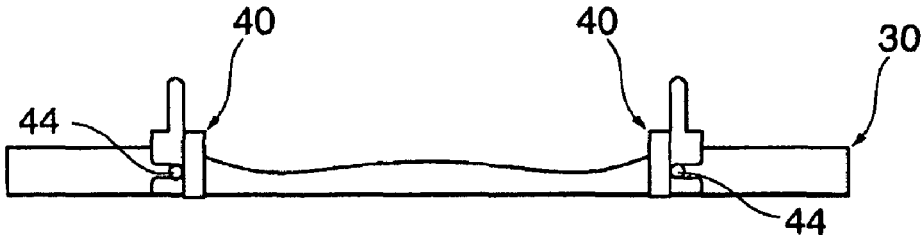
FIG. 9D is a side view showing tone plates corresponding to a mid-pitch range, and fasteners.
Figure 9E:
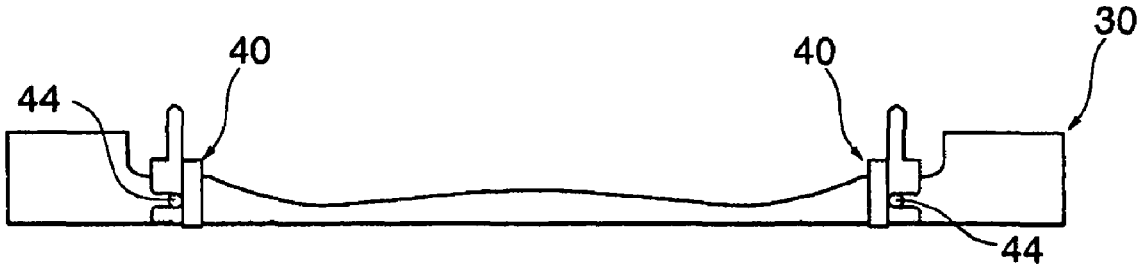
FIG. 9E is a side view showing tone plates corresponding to a low-pitch range, and fasteners.

FIG. 9A is a side view of one of fasteners 40 for collectively holding the tone plate group 30G, FIG. 9B is a fragmentary enlarged view showing the fastener 40, FIG. 9C is a side view showing a tone plate 30 corresponding to the high-pitch range portion 50C together with fasteners 40, FIG. 9D is a side view showing a tone plate 30 corresponding to the mid-pitch range portion 50B together with fasteners 40, and FIG. 9E is a side view showing a tone plate 30 corresponding to the low-pitch range portion 50A together with fasteners 40.

Generally in a celesta, tone plates for higher pitch sound may be shorter in length. As compared to tone plates 30 belonging to the low-pitch range portion 50A, tone plates 30 belonging to the mid- and high-pitch range portions 50B, 50C may be thinner in thickness of the first and second mass concentrating portions 32, 33 (refer to FIGS. 9C and 9D). Tone plates 30 belonging to the high-pitch range portion 50C are not formed with portions corresponding to the first and second thinner portions 34, 35 (refer to FIG. 9C).

The fastener 40 is made of metal or the like, and as shown in FIG. 9A, includes an engagement groove 42 adapted to be engaged with a coupling cord 44, and a pin 41 adapted to be pressed into the resonance box 50. The engagement groove 42 has a width slightly smaller than that of the coupling cord 44, and a cord receiving portion 43 that forms the back side of the engagement groove 42 is formed into a partial circle in cross-section having substantially the same diameter as that of the coupling cord 44 (refer to FIG. 9B). Thus, the coupling cord 44 can be inserted into the engagement groove 42 from the opening of the groove 42 and easily be brought in engagement with the cord receiving portion 43, while being prevented from being detached from the cord receiving portion 43 when the keyboard instrument 10 is in use for musical performance. All the fasteners 40 are formed into the same structure without distinguishing right-side use from left-side use, thereby preventing the number of types thereof from increasing.

In mounting the tone plate group 30G to the resonance box 50, the tone plates 30 forming the tone plate group 30G are first brought together using the coupling cord 44. For example, the tone plates 30 are arranged in the order of tone pitch, and the coupling cord 44 is inserted into the supporting holes 36, 37 of the tone plates 30 (the coupling cord 44 is looped counterclockwise from the lower left side of the tone plates 30 in the example shown in FIG. 8), and as a result the both ends of the coupling cords 44 are located on the left of the tone plate 30 on the lowest tone pitch side.

More specifically, the coupling cord 44 is sequentially inserted through the front supporting holes 36 of the tone plates 30 in the order of tone pitch from the front supporting hole 36 of the tone plate 30 for the lowest pitch. After inserted through the front supporting hole 36 of the tone plate 30 for the highest pitch, the coupling cord 44 is sequentially inserted through the rear supporting holes 37 of the tone plates 30 in the order of tone pitch from the rear supporting hole 37 of the tone plate 30 for the highest pitch. Finally, the both ends of the coupling cord 44 are tied together at a location on the left of the tone plate 30 for the lowest pitch. At any location the both ends of the coupling cord 44 may be tied together. Two or more cords may be used, which are tied together to form a single coupling cord 44.

As shown in FIGS. 7 and 8, the resonance box 50 has front and rear common wood walls 51, 52 that extend over substantially the entire length of the resonance box 50 in the direction in which the keys are arranged. The distance between the front and rear common walls 51, 52 is larger toward the side of the low pitch range of the resonance box 50. Thus, these common walls 51, 52 are arranged in an inverted V shape as seen from above and in the direction from left to right of the resonance box. The front and rear common walls 51, 52 each have a lower surface thereof formed with positioning holes, not shown, into which the pins 41 of the fasteners 40 can easily be fitted.

In order to mount the tone plate group 30, into which the tone plates 30 are tied together by the coupling cord 44, to the resonance box 50, the resonance box 50 is placed up side down, for example, and the pins 41 of the fasteners 40 are inserted into the positioning holes of the front and rear common walls 51, 52 of the resonance box 50 and then pressed into the positioning holes using a tool such as a hammer. The above operation is performed for all the fasteners. Subsequently, the tone plate group 30G is placed on the lower surfaces of the front and rear common walls 51, 52 of the resonance box 50, and the coupling cord 44 is engaged with the cord receiving portions 43 of the fasteners 40 at locations between the tone plates 30. Thereafter, the upside-down resonance box 50 is reversed to a normal state, whereby the tone plate group 30G is held by the resonance box 50 through the coupling cord 44 so as to be suspended therefrom, as shown in FIGS. 3 and 6. As a result, the tone generator unit UNT is constructed, in which the resonance box 50 and all the tone plates 30 are formed into one unit.

In the tone generator unit UNT, the antinode portions 31 of the tone plates 30 are disposed close to the openings formed in (the lower side of) corresponding ones of a plurality of resonance chambers (mentioned later) of the resonance box 50 so as to be capable of vibrating independently of one another. The distance between adjacent ones of the tone plates 30 is temporarily determined by the thickness of corresponding fasteners 40, and thus the pins 41 of the fasteners 40 can easily be positioned in alignment with the positioning holes, making it easy to perform the required operation. As shown in FIG. 8, the tone plate group 30G is divided into two groups in the direction in which the keys are arranged. At least one pair of front and rear positioning holes may be formed for each of these left and right groups, so that when the tone plates 30 are mounted to the resonance box 50, the distance between adjacent ones of the tone plates 30 may automatically be determined by the thickness of the fasteners concerned. It is not inevitably necessary to form the positioning holes in advance.

As shown in FIG. 6, the resonance box 50 is comprised of low-pitch, mid-pitch, and high-pitch range portions 50A, 50B and 50C that are different in type from one another. The low-pitch range portion 50A of the resonance box 50 is a Helmholtz type resonance box, in which there are provided resonance chambers RM1, which are the same in number as associated tone plates 30, so as to correspond to these tone plates 30. The mid-pitch range portion 50B is a closed-tube type resonance box, in which resonance chambers RM2 that are the same in number as associated tone plates 30 are provided so as to correspond to the tone plates 30. The resonance chambers RM1 and RM2 are referred to as the predetermined resonance chambers. The high-pitch range portion 50C is a single-type resonance box having a single resonance chamber RM3 that is common to associated tone plates 30.

As shown in FIG. 7, the front and rear common walls 51, 52 of the resonance box 50 are connected to each other by a plurality of partition plates 53 having different lengths. The partition plates 53 are made of a flat plate and extend in parallel to one another in the longitudinal and vertical directions of the resonance chambers of the resonance box 50, and are extended from lower openings of respective ones of the resonance chambers to upper ends thereof as shown in FIG. 6. The partition plates 53 are fixed at their front and rear portions to the front and rear common walls 51, 52 by adhesive or the like.

As shown in FIG. 7, between respective adjacent ones of the partition plates 53 in each of the pitch range portions 50A, 50B and 50C, two tone plates 30 are provided in the direction of array of the keys. The distance between the adjacent partition plates 53 is made slightly larger than the total width of the corresponding two tone plates 30. In the low- and mid-pitch range portions 50A and 50B, adjacent ones of the partition plates 53 are connected to each other by inclined plates 54 and 55. Between the adjacent two partition plates 53, there are two resonance chambers RM1 formed by the inclined plate 54, and two resonance chambers RM2 formed by the inclined plate 55 (refer to FIG. 6). Thus, the partition plates 53 cooperate with the inclined plates 54, 55 to form "chamber-defining portions."

As shown in FIG. 6, a lid member 56 common to the low-pitch range portion 50A is fixed to upper ends of the partition members 53 for the low-pitch range portion 50A so that upper portions of all the resonance chambers RM1 are collectively closed. In the mid-pitch range portion 50B, there are lid members 57, one for two resonance chambers RM2, that are fixed to upper ends of the partition plates 53 so that upper portions of the resonance chambers RM2 are closed. Further, one lid member 58 common to the high-pitch range portion 50C is fixed to upper ends of the partition members 53 for the high pitch range portion 50C so that an upper portion of the resonance chamber RM3 is closed.

The inclined plates 54, 55 are each formed by a flat plate that extends in the vertical direction of the resonance box 50. The inclined plates 54 extend parallel to one another, and the inclined plates 55 also extend parallel to one another. Since the inclined plates 54, 55 are basically the same in construction and function from one another, the construction of the inclined plate 55 and the resonance chamber RM2 in the mid-pitch range portion 50B will mainly be explained in the following.

Figure 10:
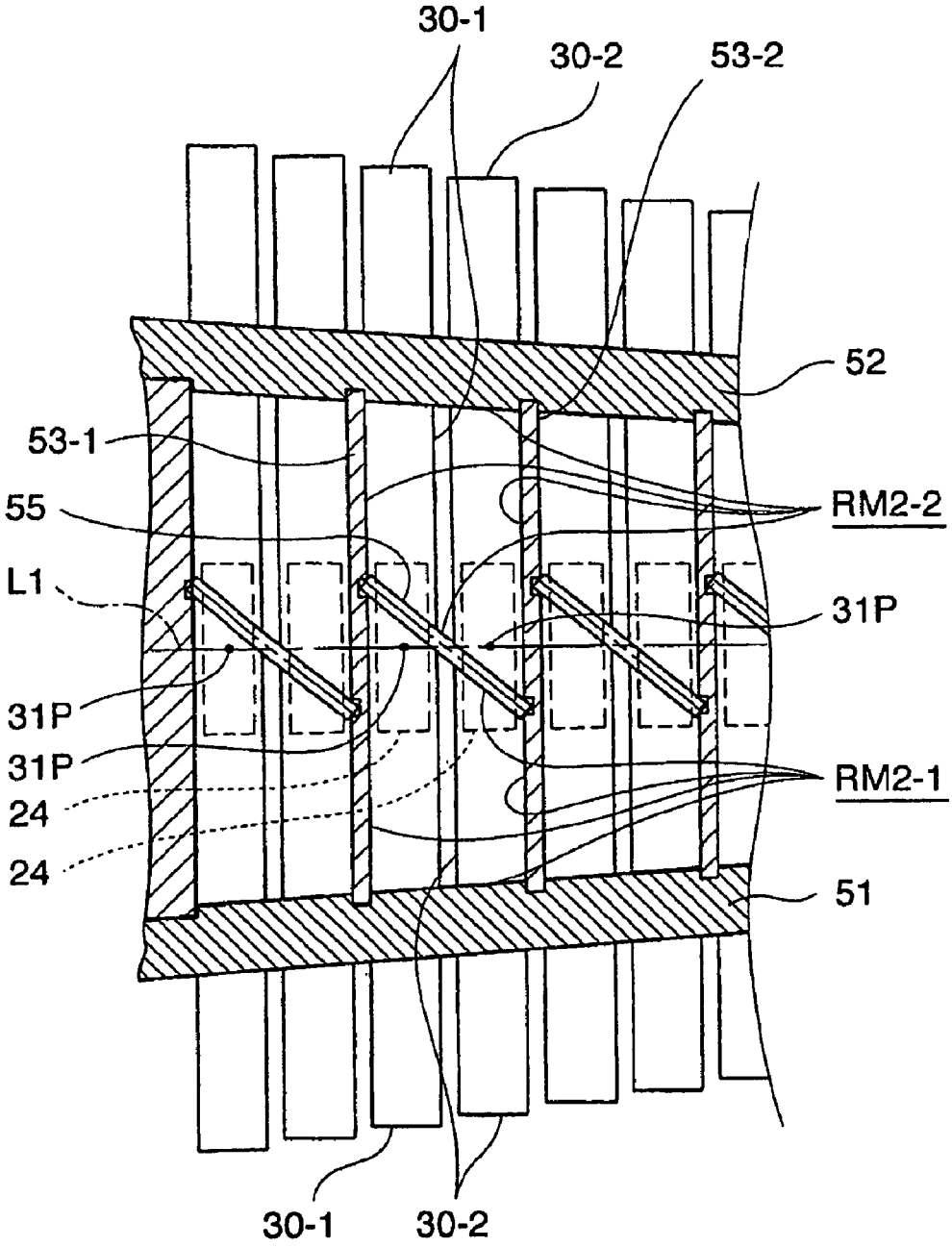
FIG. 10 is a fragmentary enlarged view showing a mid-pitch range portion of the tone generator unit shown in FIG. 7.

FIG. 10 is a fragmentary enlarged view showing the mid-pitch range portion 50B of the tone generator unit UNT shown in FIG. 7. Two resonance chambers RM2 are explained herein as a representative example, and for discrimination, suffix numeral 1 is attached to a respective one of the resonance chambers RM2, corresponding partition plates 53 and corresponding tone plates 30, whereas suffix numeral 2 is attached to a respective another of them. The inclined plate 55 connecting the two partition plates 53-1, 53-2 has both ends thereof respectively fixed by adhesive or the like to a portion of the partition plate 53-1 which is in the middle but close to the rear end of the plate 53-1 and a portion of the partition plate 53-2 which is in the middle but close to the front end of the plate 53-2 as viewed in the front-to-rear direction of these plates.

In the tone generator unit UNT, the center positions of the hammer felts 24 (refer to FIG. 2) are each in coincidence with the antinode center 31P (refer to FIGS. 5A and 5B) of the corresponding tone plate 30. The antinode centers 31P of all the tone plates 30 are the same in position in the front-to-rear direction, so that an imaginary straight line L1 shown in FIG. 10 passes through all the antinode centers 31P as seen in plan view. The straight line L1 also passes through regions of all the resonance chambers RM1, RM2, and RM3 as seen in plan view.

As shown in FIG. 10, the tone plates 30-1, 30-2 are disposed between the partition plates 53-1, 53-2. In a space defined between the partition plates 53-1 and 53-2, front and rear parts thereof on the front and rear sides with respect to the inclined plate 55 respectively correspond to the resonance chambers RM2-1 and RM2-2. As viewed in plan, the antinode center 31P of the tone plate 30-1 is included in the resonance chamber RM2-1, whereas the antinode center 31P of the tone plate 30-2 is included in the resonance chamber RM2-2. Thus, musical tones generated by the tone plates 30-1 and 30-2 respectively resonate in the resonance chambers RM2-1 and RM2-2 that are in one-to-one correspondence with the two tone plates. In this manner, the antinode centers 31P of all the tone plates 30 are each positioned within the corresponding resonance chamber RM.

In general, if too small in width, each resonance chamber of the resonance box cannot achieve a satisfactory resonance function. The resonance chambers RM2-1, RM2-2 of this embodiment are each ensured to have a sufficient width in the direction in which the keys are arranged, whereby satisfactory resonance can be realized. In addition, the tone plates 30 that are the same in number to the keys 27 and 28 are arranged within the same width as the total width of the keys in the direction of the array of these keys, and the total width of two tone plates 30 is enough to provide two resonance chambers RM2. As a result, unlike the prior art, it is unnecessary to divide the action mechanisms 20 and the tone plates 30 into two stages for the ordinarily-constructed keyboard KB, and thus they can be constructed into a single stage structure.

The inclined plate 54 in the low-pitch range portion 50A has basically the same construction as the inclined plate 55 in the mid-pitch range portion 50B although these inclined plates 54, 55 are different in angle of inclination and in length (refer to FIG. 7) due to the difference in tone plate width between the two pitch range portions 50A, 50B. As shown in FIGS. 6 and 7, a port-forming member 60 is provided in a lower portion of each resonance chamber RM1 in the low-pitch range portion 50A. At an opening of each resonance chamber RM1 (except for the resonance chamber RM1 on the left end), a port is formed by the two partition plates 53, the inclined plate 54, and the port-forming member 60. In a Helmholtz-type resonance box, a musical tone resonating therein has a tone pitch that is generally affected by the length and sectional area of the port as well as the volume of the resonance box. For example, the tone pitch at which a musical tone resonates in the resonance box decreases with the increase in port length and with the decrease in port sectional area even when the volume of the resonance box is kept unchanged. In the present embodiment, the port-forming member 60 is formed into a shape that is appropriately determined to thereby adjust the length and sectional area of the port of each resonance chamber RM1 so that a musical tone having a tone pitch determined by the corresponding tone plate 30 can satisfactorily resonate in the resonance chamber.

According to the present embodiment, the tone plates 30 belonging to the low-pitch range portion 50A are each provided with the first and second mass concentrating portions 32, 33 at its parts closer to the front and rear ends thereof with respect the supporting holes 36, 37, and the first and second thinner portions 34, 35 respectively extending between the antinode portion 31 and the first and second mass concentrating portions 32, 33, and are made of a single material (refer to FIGS. 5A and 5B). This makes it easy to shorten the entire length of the tone plate 30 and reduce the width thereof, thereby enhancing the degree of freedom in design. As a result, the keyboard instrument can be made compact in size, while covering a wide range. Since there is a general tendency that the tone plates for generating musical tones, especially those for generating low-pitch musical tones, have become larger in length, the tone plate 30 shown in FIGS. 5A and 5B is suitable for generation of low-pitch musical tones.

The tone plates 30 can easily be fabricated by removing, from one direction, that part of an unmachined member 38 which is on one side of the unmachined member as viewed in the thickness direction, wherein the unmachined member 38 is an elongated member that is rectangular in cross section and made of a single material. Thus, it is easy to fabricate the tone plates 30 and make the tone plates 30 for generating different tone pitches have the same width. In the tone generation unit UNT, the number of types of tone plate width can be reduced to three.

According to the present embodiment, moreover, the plurality of tone plates 30 are each mounted for vibration to the resonance box 50 at a location close to the opening of the corresponding resonance chamber of the resonance box 50, whereby the resonance box 50 and the tone plates 30 are unified into the tone generation unit UNT. Thus, it is easy to replace the tone generation unit UNT by a new tone generation unit where an appropriate positional relation is also retained between the resonance box 50 and the tone plates 30. For example, replacement to a new tone generation unit that is different in construction of tone plates and/or resonance box makes it possible to easily change tone colors even in the acoustic tone plate percussion instrument. In addition, such easy replacement of tone generation units UNT makes it easy to perform maintenance of the tone plate group 30G and/or the resonance box 50.

Moreover, the plurality of tone plates 30 are collectively held for vibration by the coupling cord 44, and the coupling cord 44 is mounted to the resonance box 50 by means of the plurality of fasteners 40. In particular, the tone plates 30 are made thick at locations where vibration nodes are formed, which makes it possible to form the supporting holes 36, 37 in the tone plates 30 so as not to extend in the vertical direction but extend in the direction in which the keys are arranged. Since the supporting holes 36, 37 extend in the direction of array of the keys, the tone plates 30 constituting the tone plate group 30G can be held collectively by the coupling cord 44 in a state where they are suspended from the resonance box 50. This makes it possible to collectively handle the tone plate group 30G and collectively mount and dismount the tone plate group 30G to and from the resonance box 50 for ease of mounting and replacement the tone plates 30. Since the supporting holes 36 and 3 are formed in the tone plates 30 at locations where vibration nodes are formed, these holes do not hinder the tone plates from performing satisfactory sounding.

In mounting the tone plates 30, the distance between adjacent ones of the tone plates 30 is temporarily fixed by the fasteners 40. This makes it easier to mount and replace the tone plates 30.

It is not inevitably necessary to form the supporting holes 36, 37 in the form of through holes so long as the plurality of tone plates can be collectively held by a cord member such as the coupling cord 44. For example, each of these supporting holes may be a groove which is formed into a partial circle in cross section and opens to the lower surface of the tone plate 30. From the view point of achieving the function of collectively holding the plurality of tone plates, the cord used therefor is not necessarily be limited to the coupling cord 44. It should be noted that it is not inevitably necessary to collectively hold all the tone plates, but the tone plate group 30G may be divided into two groups or more, and each of the divided tone plate groups may be held together.

According to the present embodiment, the resonance chambers RM1, RM2 for the low- and mid-pitch range portions 50A, 50B are each ensured to have a sufficient width in the direction of array of the keys, which is equal to or wider than the total width of corresponding two tone plates 30, thereby making it possible to achieve satisfactory resonance. In addition, the resonance chambers RM1, RM2 are so defined as to overlap each other as viewed from front, whereby the resonance box 50 can be constructed to have a shortened length in the direction of array of the keys, while ensuring an appropriate width of each resonance chamber. As a result, the tone plate group 30G and the resonance box 5 of the entire keyboard instrument can be constructed into a single-stage structure.

The keyboard instrument is constructed that the imaginary straight line L1 passes through all the resonance chambers RM1, RM2, and RM3, and the antinode centers 31P (refer to FIGS. 5A and 5B) of all the tone plates 30 are at the same position as viewed in the front-to-rear direction of the keyboard instrument, thereby making it possible to unify operation feelings between all the tone plates 30 and make the tone plate group 30G compact in size in the longitudinal direction of the tone plates 30.

The resonance chambers RM1, RM2 are defined by the plurality of partition plates 53 through which the front and rear common walls 51, 52 are connected and the inclined plates 54, 55 through which adjacent ones of the partition plates 53 are connected, whereby these resonance chambers can be defined with a simple construction and can be fabricated with ease since in particular the plurality of partition plates 53 extend parallel to one another.

Moreover, unlike the conventional upper and lower two-stage structure, the present embodiment, in which the tone plate group 30G and the resonance box 50 of the entire keyboard instrument can have a single-stage structure, does not require a long coupling rod for transmitting a key-depressing operation to a lower group of percussion units. The single-stage structure is simple in construction and can easily be made light in weight. The tone plates 30 corresponding to the white keys 27 and the tone plates 30 corresponding to the black keys 28 are the same in vertical position, making it easy to balance sounds from the tone plates corresponding to the white and black keys. Furthermore, unlike the upper and lower two-stage structure, sounds output from tone plates 30 are not interrupted by the lower tone plate group, lower percussion unit group, and lower resonance box. Thus, the resultant instrument is simple in construction and light in weight and capable of easily unifying key-operation feelings and of efficiently outputting well-balanced sounds. Besides, the sound output ports 14*a* are formed in the keybed 14 below the action mechanisms 20, and therefore the tone plates 30 can output sounds directly to the outside, thereby enhancing the sound output efficiency.

Figure 11:
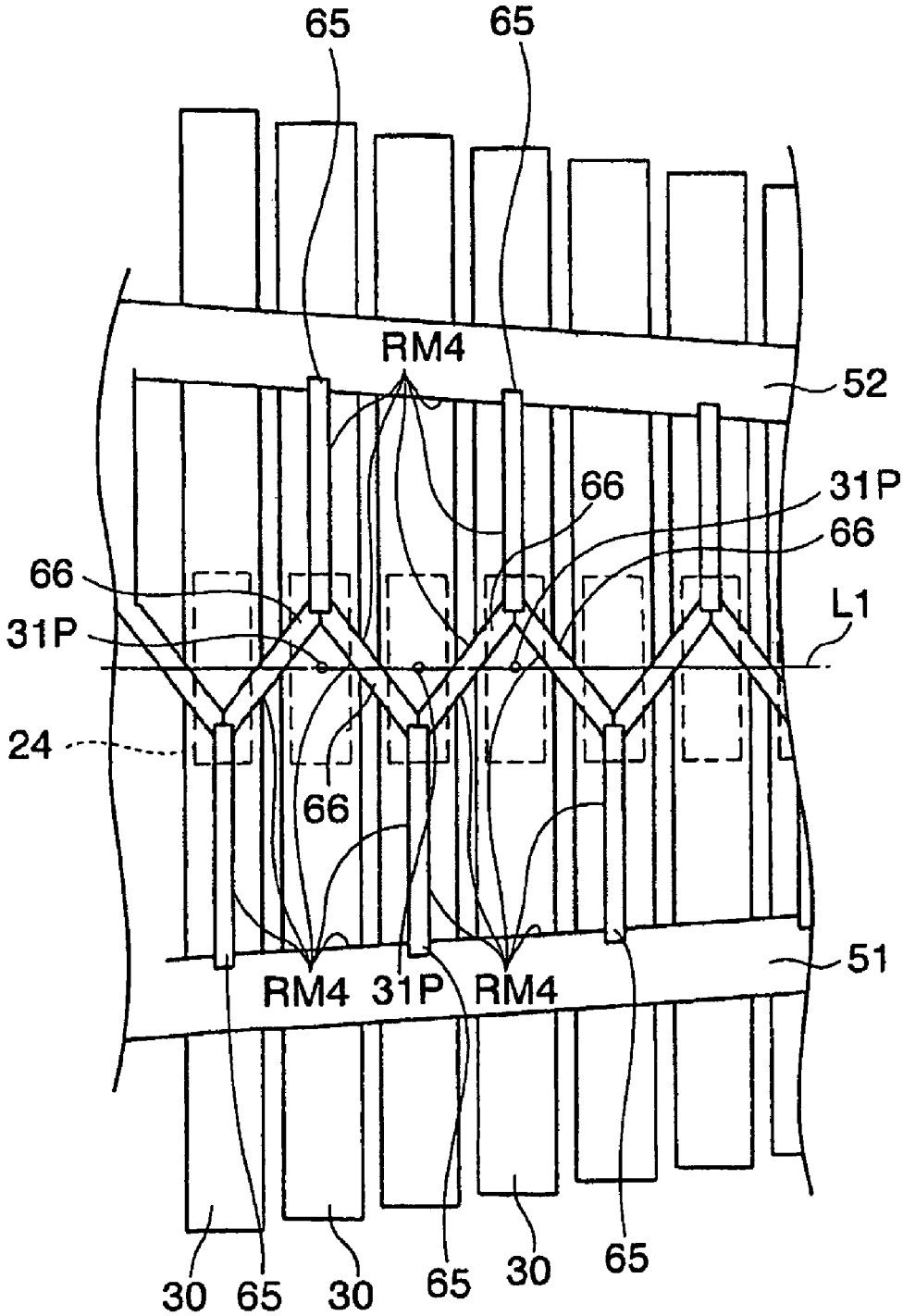
FIG. 11 is a fragmentary enlarged view showing a mid-pitch range portion of a resonance box in a keyboard-type tone plate percussion instrument to which is applied a tone generator unit that includes a plurality of tone plates, which are sounding members according to a second embodiment of the present invention.

In the following, a second embodiment of the present invention will be explained. As compared to the first embodiment, the second embodiment differs in the construction of the resonance box 50 of the tone generator unit UNT, but is the same in other respects. FIG. 11 which is similar to FIG. 10 is a fragmentary enlarged view showing amid-pitch range portion of the resonance box in a keyboard-type tone plate percussion instrument to which is applied a tone generator unit that includes a plurality of tone plates, which are sounding members according to the present embodiment.

In the first embodiment, the plurality of partition plates 53 in the low- and mid-pitch range portions 50A, 50B are each connected at its both ends with the front and rear common walls 51, 52. On the contrary, in the second embodiment, there are provided a plurality of partition plates 65 whose length is as large as about the half of the length of the partition plates 53. These partition plates 65 are connected at their one ends with either the first or second common wall 51 or 52, as shown in FIG. 11. In other respects, the partition plates 65 are the same in construction as the partition plates 53.

In the first embodiment, adjacent ones of the partition plates 53 are connected to each other by the inclined plates 54, 55. In the second embodiment, closely arranged two partition plates 65 in the low- and mid-pitch range portions 50A, 50B have other ends (which are not connected to either the front or rear common wall 51 or 52) thereof connected to each other through an inclined plate 66, as shown in FIG. 11. A single resonance chamber RM4, which is referred to as the predetermined resonance chamber, is formed by adjacent two partition plates 65 and two inclined plated 66 connected to the other ends of these two partition plates 65. In other words, the partition plates 65 cooperate with the inclined plates 66 to constitute the "chamber-forming portion."

Also in the resonance box 50 shown in FIG. 11, the antinode centers 31P of all the tone plates 30 are the same in position as viewed in the front-to-rear direction (refer to FIGS. 5A and 5B), and an imaginary straight line L1 passing through all the antinode centers 31P also passes through regions of all the resonance chambers RM4 as seen in plan view. In the low- and mid-pitch range portions 50A, 50B, each resonance chamber RM4 overlaps the adjacent resonance chambers RM4 and is ensured to have a sufficient width in the direction of array of the keys, which is equal to or larger than the total width of corresponding two tone plates 30.

According to the present embodiment, effects which are the same as those attained by the first embodiment can be attained. Furthermore, the antinode center 31P of each of the tone plates 30 is positioned at the center of the corresponding resonance chamber RM4 in the direction of array of the keys, and therefore, the second embodiment is more advantageous than the first embodiment in achieving satisfactory resonance.

In order to only ensure an appropriate width of each resonance chamber in the low- and mid-pitch range portions 50A, 50B to realize satisfactory resonance as well as to realize a single-stage structure of the tone plate group and the resonance box for the entire musical instrument, it is enough if the following conditions are satisfied. Specifically, each of the plurality of resonance chambers must overlap another resonance chamber as seen in plan view, and the maximum width of each resonance chamber in the direction in which the tone plates are arranged must be equal to or larger than the total width of two tone plates corresponding thereto. The type of a material to construct respective portions of the resonance box 50 is not limited to wood. For example, the partition plates and the inclined plates disposed between the front and rear common walls may be made of a resin and may integrally be formed so as to construct the plurality of resonance chambers. Furthermore, the partition plates and the inclined plates may be formed integrally with the front and rear common walls 51, 52 into meshes each of which constitutes one resonance chamber.

In the following, modifications of the resonance box are shown, each of which may be adopted, if necessary, although they are inferior in effect to the first and second embodiments. FIGS. 12A to 12D are fragmentary views showing the modifications of the resonance box.

Figure 12A:
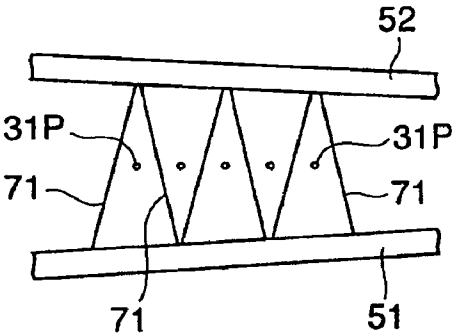
FIG. 12A is a fragmentary section view showing a first modification of the resonance box.

As shown by way of example in FIG. 12A, inclined partition plates 71 may be disposed between the front and rear common walls 51, 52 so that one resonance chamber is formed between adjacent two of the partition plates 71, with apex portions of the resonance chambers alternately appearing on the front common wall and on the rear common wall. In this modification, the partition plates 71 constitute the "chamber-forming portions."

Figure 12B:
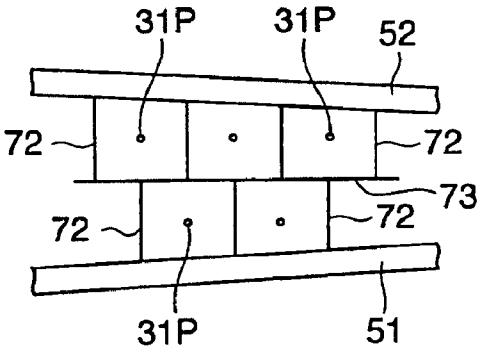
FIG. 12B is a fragmentary section view showing a second modification of the resonance box.
Figure 12C:
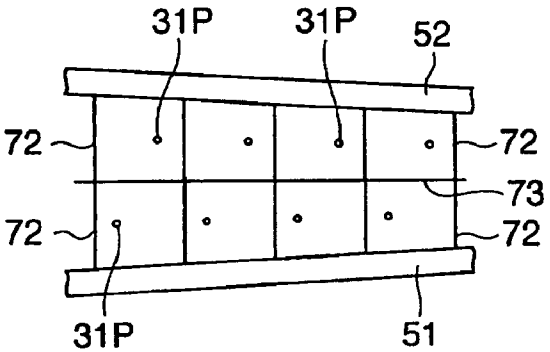
FIG. 12C is a fragmentary section view showing a third modification of the resonance box.

As shown in FIGS. 12B and 12C, a plate member 73 may be disposed between the front and rear common walls 51, 52 so as to extend in the direction of array of the keys, and a plurality of partition plates 72 each connecting the plate member 73 and the front or rear common wall 51 or 52 may be provided, so that there are formed resonance chambers of a two-stage structure as seen in the front-to-rear direction.

Figure 12D:
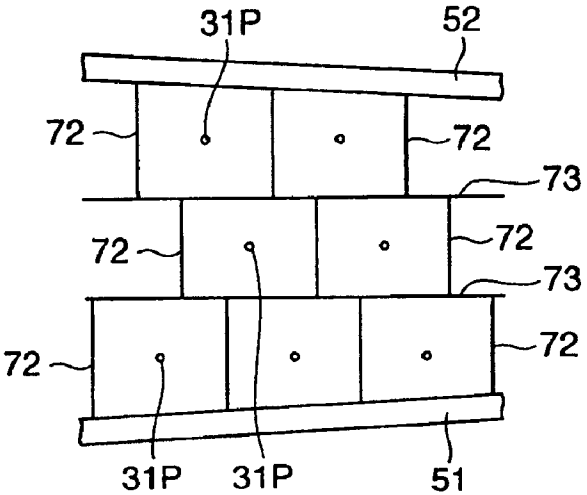
FIG. 12D is a fragmentary section view showing a fourth modification of the resonance box.

As shown in FIG. 12D, there may be provided two plate members 73 between the front and rear common walls 51, 52 as well as a plurality of partition plates 72 each connecting the two plates members 73 with each other, connecting the front-side plate member 73 with the front common wall 51, or connecting the rear-side plate member 73 with the rear common wall 52, so as to construct a resonance chamber of a three-stage structure as seen in the front-to-rear direction. Of course, the number of stages in the front-to-rear direction is not limited two or three. In the modifications shown in FIGS. 12B to 12D, the partition plates 72 and the plate members 73 constitute the "chamber-forming portions."

It should be noted that the modification shown in FIG. 12A where the partition plates 71 do not extend parallel to one another has a disadvantage that the ease of fabrication is lowered. The modifications shown in FIGS. 12B to 12D are disadvantageous in that the antinode centers 31P of the tone plates 30 cannot have the same position in the front-to-rear direction.

In the following, a third embodiment of the present invention will be explained. In the third embodiment, the keyboard KB and the action mechanisms 20 are made variable in position in the direction of array of the keys with respect to the tone generator unit UNT. The third embodiment is the same (including the tone generator unit UNT) in construction as the first embodiment, expect for mechanisms for making the keyboard KB and the action mechanisms 20 movable.

Figure 13:
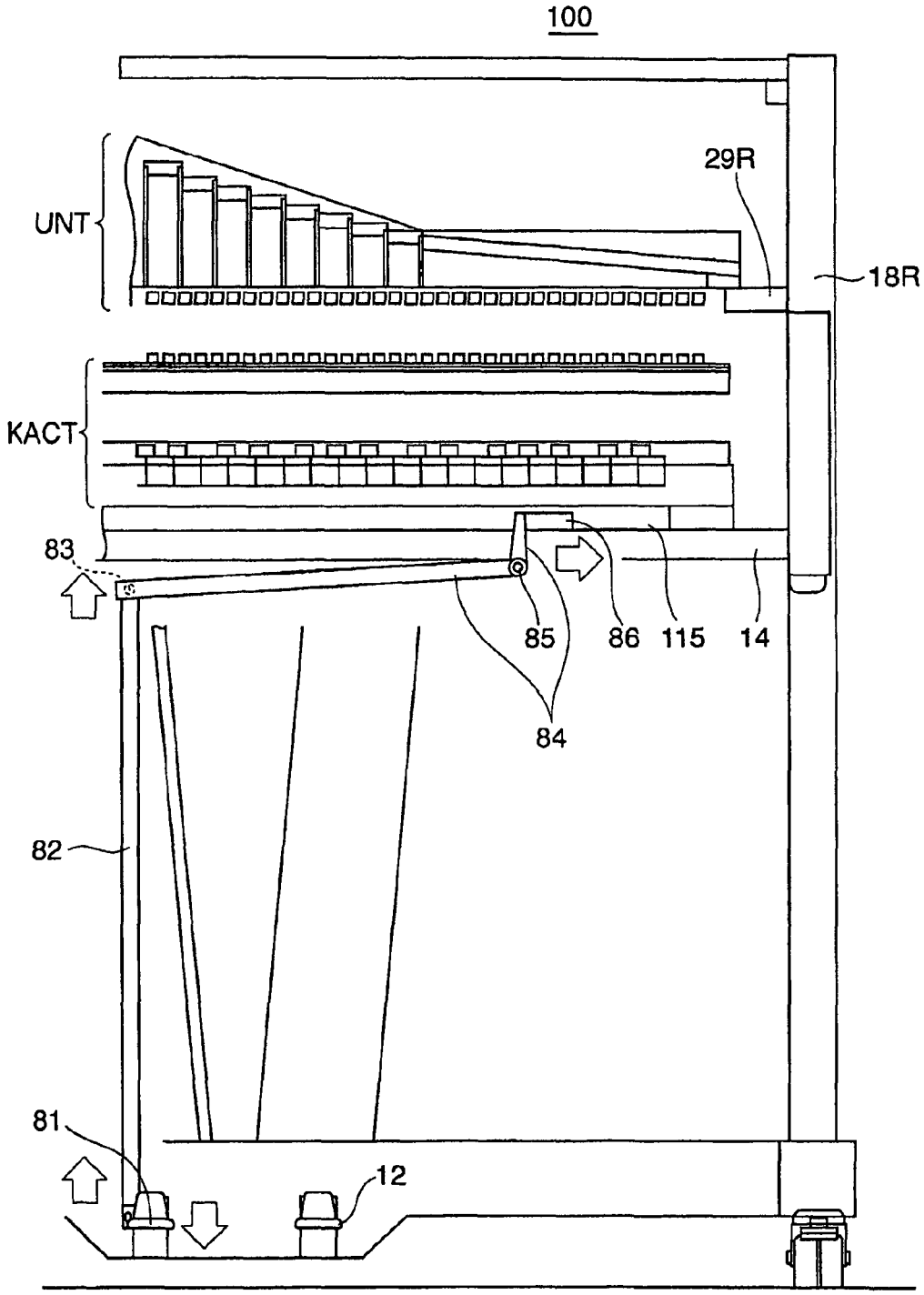
FIG. 13 is a front view showing the internal construction of a keyboard instrument constructed as a keyboard-type tone plate percussion instrument to which is applied a tone generator unit that includes a plurality of tone plates, which are sounding members according to a third embodiment of the present invention.

FIG. 13 is a front view showing the internal construction of a keyboard instrument constructed as a keyboard-type tone plate percussion instrument to which is applied a tone generator unit that includes a plurality of tone plates, which are sounding members according to the present embodiment, and mainly shows the right half of the keyboard instrument. In the keyboard instrument 100, a support 115 is disposed on a keybed 14, and a keyboard action unit KACT comprised of the keyboard KB and the action mechanisms 2 is disposed on the support 115. The support 115 is constructed to be movable in the left-to-right direction as in the case of a grand piano in which the support is moved in the left-to-right direction (the direction of array of the keys) in response to a shift pedal operation. A movable amount of the support 115 is set to an extent enough to permit key transposition (for example, an amount of five degrees).

In addition to the damper pedal 12, a key transposition pedal 81 is provided in a lower portion of the keyboard instrument 100. A coupling rod 82 is coupled to the key transposition pedal 81. An L-shaped link 84 is provided for clockwise pivotal motion around a pivot shaft 85 that is provided in the main body of the keyboard instrument 100. One end of the L-shaped link 84 is coupled to the coupling rod 82 for pivotal motion around a pivot shaft 83. Further, a pressing member 86 for driving the support 115 in the left-to-right direction is provided in the vicinity of a right side of the support 115. The support is always urged toward the left by means of an urging member such as a spring, not shown, which is provided in a side plate 18R, and another end of the L-shaped link 84 is in contact with the pressing member 86.

Although not illustrated, the tone generator unit UNT is provided with the tone plates 30 that are larger in number than the total number of the white and black keys 27, 28 in the keyboard action unit KACT so as to correspond to the tone generation range that varies according to key transposition range.

In the above construction, when the key transposition pedal 81 is stepped on, the coupling rod 82 is moved upward to rotate the L-shaped link 84 clockwise in FIG. 13, thereby urging the pressing member 86 to the right. As a result, the pressing member 86 causes the support 115 to slide/move to the right against the aforementioned urging member, not shown. At this time, the keyboard action unit KACT is moved in unison with the support 115. Since the tone generator unit UNT is fixed in position via supporting portions 29L, 29R relative to side plates 18L, 18R, there occurs a shift in the relationship between the tone plates 30 in the tone generator unit UNT and the action mechanisms 20 in the keyboard action unit KACT. As a result, the same effect as key transposition can be attained. On the other hand, when the key transposition pedal 81 is released, the keyboard action unit KACT is returned to the original position in unison with the support 115, and hence the original key is resumed.

According to the present embodiment, the key transposition can be made in the percussion instrument that acoustically generates sounds, making it possible to provide a variety in performance form. Since the keyboard KB and the action mechanisms 20 are moved together, a mechanism for shift alteration in a grand piano can be applied, making it possible to carry out the key transposition with a simple construction. Besides, satisfactory resonance of a musical tone generated by each tone plate 30 can still be attained since the correspondence relationship between the tone plates 30 and the resonance chambers is fixed.

To permit the key transposition, it is enough to construct the keyboard action unit KACT and the tone generator unit UNT so that the relative position therebetween can be varied. Instead of the keyboard action unit KACT, the tone generator unit UNT may be constructed for sliding motion.

In the present embodiment, as the operating member for driving the pressing member 86, a foot-operated member such as the key transposition pedal 81 is used, but this is not limitative. A hand-operated member may be used. The direction of key transposition in the embodiment is a direction to raise the key, but this is not limitative. Key transposition may be made in a direction in which the key is lowered.

Next, a fourth embodiment of this invention will be explained. Unlike the third embodiment where the key transposition state is sustainable only when the key transposition pedal 81 is being stepped on, the fourth embodiment is so designed that the key transposition state can be maintained. To this end, the fourth embodiment is provided with a mechanism for key transposition different from that of the third embodiment, whereas the construction of the tone generator unit UNT, the keyboard action unit KACT, and the like is the same as that of the third embodiment.

Figure 14B:
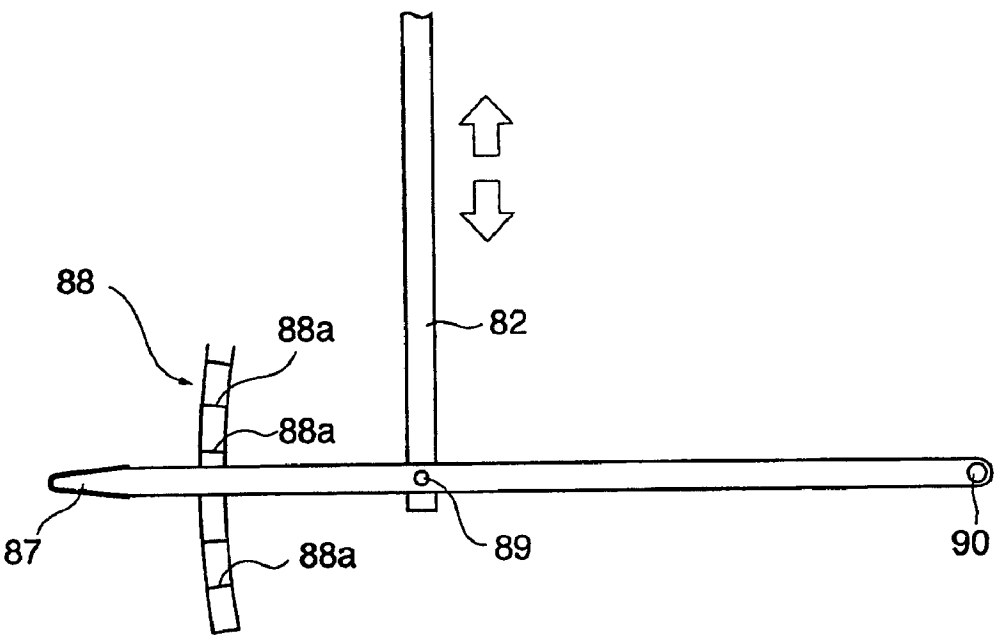
FIG. 14B is an inner side view showing a left side plate of the keyboard instrument.
Figure 14A:
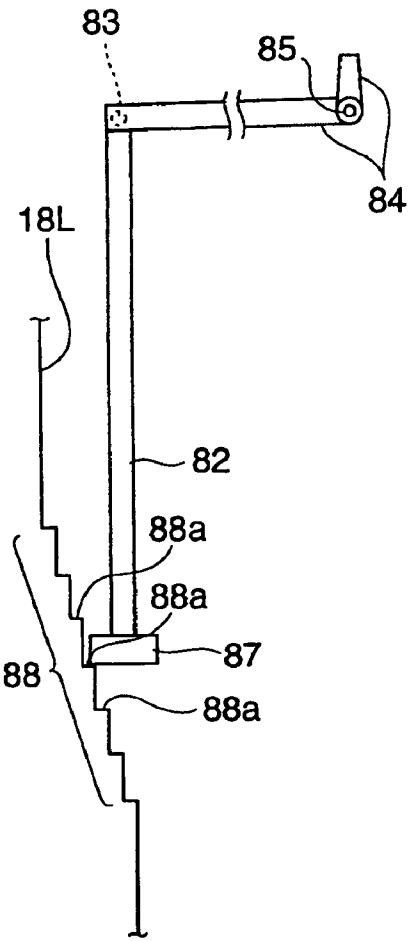
FIG. 14A is a front view showing a mechanism for key transposition in a keyboard instrument constructed as a keyboard-type tone plate percussion instrument to which is applied a tone generator unit that includes a plurality of tone plates, which are sounding members according to a fourth embodiment of the present invention.

FIG. 14A is a front view showing a mechanism for key transposition in a keyboard instrument constructed as a keyboard-type tone plate percussion instrument to which is applied a tone generator unit that includes a plurality of tone plates, which are sounding members according to the fourth embodiment. In FIG. 14A, the left side of the keyboard instrument is shown. FIG. 14B is an inner side view showing a left side plate of the keyboard instrument.

In the mechanism for key transposition, the coupling rod 82, pivot shaft 83, L-shaped link 84, pivot shaft 86, and support 115 have the same construction as those of the third embodiment except for their shapes and lengths. As shown in FIGS. 14A and 14B, on an inner side surface (right side surface) of the side plate 18L, there is provided a hand-operated lever 87 for pivotal motion around a pivot shaft 90. The lever 87 has its intermediate portion that is coupled to a lower end of the coupling rod 82 so as to be pivotable around a pivot shaft 89.

Further, a stepped positioning stopper portion 88 is formed in the inner side surface (right side surface) of the side plate 18. The stopper portion 88 is formed into a circular shape, as seen in side view, extending in the direction in which the lever 87 is pivoted (refer to FIG. 14B), and is comprised of a plurality of steps 88*a*. The distance between vertically adjacent ones of the steps 88*a* corresponds to a distance required for half-tone transposition.

With the above construction, a user grasps the lever 87 by hand and changes the step 88*a* to which the lever 87 is to be engaged, where required. For example, when the lever 87 is brought in engagement with the next upper step 88*a*, the pressing member 86 is urged to the right through the coupling rod 82 and the L-shaped link 84, so that the support 115 is slidingly moved to the right for an amount corresponding to half-tone. To lower the key, it is enough to engage the lever 87 with a lower step 88*a*.

According to the present embodiment, the same advantages as those attained by the third embodiment can be attained. In addition, key transpositions in both the directions to raise and lower the key can be made, and the resultant key transposition state can be maintained even after the player releases the lever 87.

The key transposition mechanism may be constructed to have both the mechanism of the third embodiment that performs key transposition only when the transposition pedal 81 is ON and the mechanism of the fourth embodiment that maintains the key transposition state.

The present invention is also applicable to glockenspiels.

What is claimed is:

1. A tone generator unit of a tone plate percussion instrument, comprising:

a plurality of tone plates each adapted to vibrate to generate a musical tone of a specific tone pitch when struck, each tone plate having a respective length and width;

a resonance box having first and second common walls extending substantially in the width direction of said plurality of tone plates;

at least two chamber-defining members formed between the first and second common walls the at least two chamber-defining members being spaced apart at least the width of two adjacent tone plates;

a plate member formed between the at least two chamber-defining members and defining two resonance chambers, each resonance chamber corresponding to a respective one of said two adjacent tone plates and each having an opening side thereof, wherein said plurality of tone plates are mounted to said resonance box so as to be capable of vibrating whereby said resonance box and said plurality of tone plates are formed into one unit.

2. The tone generator unit according to claim 1, further including:

a holder member for collectively holding at least two of said plurality of tone plates so as to be capable of vibrating; and attachment members for attaching said holder member to said resonance box.

3. The tone generator unit according to claim 2, wherein said holder member is comprised of a cord member, each of said at least two of said plurality of tone plates is formed with through holes that extend in a direction of array of said plurality of tone plates, and said holder member passes through the through holes formed in said at least two of said plurality of tone plates whereby said at least two of said plurality of tone plates are held by said holder member so as to be suspended therefrom.

4. The tone generator unit according to claim 2, wherein a distance between adjacent ones of said plurality of tone plates is temporarily determined by an associated at least one of said attachment members when said plurality of tone plates are mounted to said resonance box.

5. The tone generator unit according to claim 1, further comprising a plurality of chamber-defining members and a plurality of plate members that define a plurality of resonance chambers, among the plurality of resonance chambers, a plurality of predetermined resonance chambers corresponding to at least part of a range of the percussion instrument, and each of the plurality of predetermined resonance chambers overlaps at least one of other predetermined resonance chambers as seen from front thereof.

6. A tone generator unit of a tone plate percussion instrument, comprising:

a plurality of tone plates each adapted to vibrate to generate a musical tone of a specific tone pitch when struck;

a resonance box having a plurality of resonance chambers, corresponding to respective ones of said plurality of tone plates and each having an opening side thereof;

a holder member for collectively holding at least two of said plurality of tone plates so as to be capable of vibrating wherein the holding member is a cord; and a plurality of fasteners, each of said plurality of fasteners having an engagement portion that receives and secures said holder member wherein the engagement portion of said fasteners is a groove for receiving said cord and a fastening portion for fastening said fasteners to said resonance box, wherein said plurality of tone plates are mounted to said resonance box by said holding member and said fasteners so as to be capable of vibrating, with each of the tone plates located close to the opening side of a corresponding one of the resonance chambers, whereby said resonance box and said plurality of tone plates are formed into one unit.

7. The tone generator unit according to claim 6, wherein the fastening portion of said fasteners is a pin that is fitted into a hole in said resonance box.

* * * * *